US010297930B2

(12) United States Patent
Wu et al.

(10) Patent No.: US 10,297,930 B2
(45) **Date of Patent: *May 21, 2019**

(54) ELECTRICAL CONTACT LIMITER STRUCTURE OF WIRE CONNECTION TERMINAL

(71) Applicants: SWITCHLAB INC., New Taipei (TW); SWITCHLAB (SHANGHAI) CO., LTD., Shanghai (CN)

(72) Inventors: Chih-Yuan Wu, New Taipei (TW); Cherng Shin Wu, New Taipei (TW)

(73) Assignees: Switchlab Inc., New Taipei (TW); Switchlab (Shanghai) Co., Ltd., Shanghai (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/618,468

(22) Filed: Jun. 9, 2017

(65) Prior Publication Data

US 2017/0365938 A1 Dec. 21, 2017

(30) Foreign Application Priority Data

Jun. 20, 2016 (TW) ..... 105119331 A

(51) Int. Cl.
*H01R 4/24* (2018.01)
*H01R 4/48* (2006.01)
*H01R 4/58* (2006.01)

(52) U.S. Cl.
CPC ..... *H01R 4/4818* (2013.01); *H01R 4/58* (2013.01)

(58) Field of Classification Search
CPC ..... H01R 4/4818
USPC ..... 439/439, 440, 441
See application file for complete search history.

(56) References Cited

U.S. PATENT DOCUMENTS 5,685,735 A * 11/1997 Hohorst ..... H01R 4/4836 439/441
6,280,233 B1 * 8/2001 Beege ..... H01R 4/4827 439/441
6,682,364 B2 * 1/2004 Cisey ..... H01R 9/2666 439/441
6,796,855 B2 * 9/2004 Fricke ..... H01R 4/4818 439/835
7,004,781 B2 * 2/2006 Walter ..... H01R 4/4836 439/268
7,244,140 B2 * 7/2007 Edenharter ..... H01R 4/4818 439/439

(Continued)

*Primary Examiner* — Neil Abrams
(74) *Attorney, Agent, or Firm* — Rosenberg, Klein & Lee

(57) ABSTRACT

An electrical contact limiter structure of wire connection terminal has a simplified structure and is easy to operate to enhance the stability of the operation and motion of a metal leaf spring. The wire connection terminal includes conductive components mounted in the insulation case and electrical contact assembled with the conductive components. The electrical contact has a limiter for receiving the metal leaf spring and restricting moving path thereof. The limiter is partitioned into at least one space. A limitation mechanism is assembled with the limiter. The metal leaf spring is mounted in the space. The wiring circuits or conductive wires coming from an apparatus can be easily directly plugged into the space of the limiter to insert with the metal leaf spring. The limiter and the limitation mechanism cooperatively prevent the metal leaf spring from being deflected and over-bent and damaged in operation.

20 Claims, 17 Drawing Sheets

(56) References Cited

U.S. PATENT DOCUMENTS

| | | | | |
|---|---|---|---|---|
| 7,287,999 | B2 * | 10/2007 | Holterhoff | H01R 4/4836 439/441 |
| 7,344,422 | B2 * | 3/2008 | Helmreich | H01H 50/14 439/709 |
| 7,507,106 | B2 * | 3/2009 | Keswani | H01R 4/4818 439/439 |
| 7,507,107 | B2 * | 3/2009 | Tuerschmann | H01R 4/4836 439/441 |
| 7,648,371 | B2 * | 1/2010 | Boensch | H01L 31/02013 439/76.1 |
| 7,785,134 | B2 * | 8/2010 | Dhandapani | H01R 4/4818 439/441 |
| 8,292,677 | B2 * | 10/2012 | Gassauer | H01R 13/15 439/729 |
| 8,858,269 | B2 * | 10/2014 | Brand | H01R 4/4827 439/733.1 |
| 9,466,911 | B1 * | 10/2016 | Wu | H01R 4/4836 |
| 9,735,515 | B2 * | 8/2017 | Wu | H01R 4/4827 |
| 9,774,107 | B2 * | 9/2017 | Kamo | H01R 9/2416 |
| 9,865,940 | B2 * | 1/2018 | Sichmann | H01R 4/4836 |
| 9,899,751 | B2 * | 2/2018 | Wu | H01R 4/4809 |
| 9,922,778 | B2 * | 3/2018 | Wu | H01H 1/58 |
| 2017/0365939 | A1 * | 12/2017 | Wu | H01R 4/58 |
| 2018/0301825 | A1 * | 10/2018 | Wu | H01R 4/4818 |
| 2018/0342817 | A1 * | 11/2018 | Wu | H01R 4/4818 |

* cited by examiner

ELECTRICAL CONTACT LIMITER STRUCTURE OF WIRE CONNECTION TERMINAL

BACKGROUND OF THE INVENTION

1. Field of the Invention

The present invention relates generally to an electrical contact limiter structure of wire connection terminal, and more particularly to an electrical contact equipped with a limiter and a limitation mechanism assembled with the metal leaf springs. The limiter and a limitation mechanism serve to help in restricting the moving path of the metal leaf springs.

2. Description of the Related Art

A conventional wire connection terminal device has an insulation case (generally made of plastic material), a metal component (or so-called electrical conductive component) and a metal leaf spring. The metal component and the metal leaf spring are enclosed in the insulation case to press and electrically connect with a conductive wire plugged in the terminal device. The terminal device can be mounted on an operation panel or a distributor box of an electronic or electrical apparatus as an electrical wiring connection device. With respect to the operation and application of the assembling structure of the conventional wire connection terminal, when the conductive wire is plugged into the case and the wire connector, the conductive wire will first press down the metal leaf spring. Then, the metal leaf spring applies an elastic force to the conductive wire to bite or hold the conductive wire together with the wire connector so as to electrically connect with the conductive wire. It often takes place that when the conductive wire is plugged into the case, due to the large number of plug-in operation and human negligence, the metal bare end of the conductive wire thrusts and damages the case or deflects the metal leaf spring to scrape and break the case and fail to stably hold the conductive wire. In order to improve the above problem, a conventional wire connector limiter is assembled with the wire connector to restrict the moving path of the metal leaf spring.

In operation and detachment process of the conventional wire connection terminal with the electrical contact, the limiter structure and the metal leaf spring, a tool (such as a screwdriver or the like) is used to press down the metal leaf spring and forcedly bend the metal leaf spring so as to release the conductive wire from the pressing or biting of the metal leaf spring. However, as well known by those who are skilled in this field, due to the negligence of the operator or in order to truly release the conductive wire from the pressing or biting of the metal leaf spring, the operator often instinctively applies an excessively great force to the metal leaf spring to forcedly over-bend the metal leaf spring. As a result, during the long-term or frequent operation, the metal leaf spring is often pressed down and over-bent. This is easy to cause material fatigue of the metal leaf spring to affect the pressing or biting effect of the metal leaf spring for the conductive wire. This is not what we expect.

To speak representatively, the above reveals some shortcomings existing in the conventional electrical connection terminal or wire connector and metal leaf spring and the relevant assembling design. In case the structure and assembly of the wire connector and the metal leaf spring are redesigned to be different from the conventional wire connection terminal, the use form of the wire connection terminal can be changed to practically widen the application range thereof. For example, in the condition that the development and design trend of miniaturized terminal device are satisfied and the volume of the terminal device is not increased, the fixing structures or assembling relationship of the conventional wire connector and metal leaf springs are changed, whereby the structure of the terminal device is easy to manufacture and operate so as to improve the shortcomings of the conventional terminal device that the operation is troublesome and time-consuming and the structure is relatively complicated.

In addition, a wire connection terminal device (or electrical contact) equipped with a limiter and a limitation mechanism is provided. The limiter is connected with the limitation mechanism to truly receive the metal leaf springs and restrict the moving path of the metal leaf springs. Moreover, when an external operational force is applied to the metal leaf spring, the limitation mechanism serves to prevent the metal leaf springs from being over-bent. This is specially considered and required. All the above issues are not specifically suggested or disclosed in the above reference patents.

SUMMARY OF THE INVENTION

It is therefore a primary object of the present invention to provide an electrical contact limiter structure of wire connection terminal, which has a simplified structure and is easy to operate to enhance the stability of the operation and motion of a metal leaf spring. The wire connection terminal includes conductive components mounted in the insulation case and electrical contact assembled with the conductive components. The electrical contact has a limiter for receiving the metal leaf spring and restricting moving path thereof. The limiter is partitioned into at least one space. A limitation mechanism is assembled with the limiter. The metal leaf spring is mounted in the space. The wiring circuits or conductive wires coming from an apparatus can be easily directly plugged into the space of the limiter to insert with the metal leaf spring. The limiter and the limitation mechanism cooperatively prevent the metal leaf spring from being deflected and over-bent and damaged in operation.

To achieve the above and other objects, the electrical contact limiter structure of the present invention includes a limiter and a limitation mechanism. The limiter includes a first side, a second side connected with the first side, a third side connected with the second side and a fourth side connected with the third side to together form a rectangular frame structure. The first side is bent toward the third side to forma first subsidiary side so as to define a first space. The fourth side is bent toward the second side and extends to form a fifth side. The fifth side and the first side are positioned on the same plane face. The fifth side is bent toward the third side to form a second subsidiary side so as to define a second space. The first and second subsidiary sides are side by side arranged in parallel to each other.

In the above electrical contact limiter structure, the limitation mechanism includes assembling sections at least formed on the second and fourth sides and a stopper body (detachably) disposed on the assembling sections. The stopper body is a bolt body passing through the assembling sections for restricting the moving range or bending angle of the metal leaf spring. Therefore, when an external operational force is applied to the metal leaf spring, the metal leaf spring is prevented from being over-bent to cause material fatigue or breakage.

In the above electrical contact limiter structure, the limitation mechanism includes assembling sections at least formed on the second and fourth sides and stopper bodies disposed on the assembling sections. The stopper bodies are plate structures (transversely) extending and protruding from the assembling sections toward the interior of the limiter or the first and second spaces.

The present invention can be best understood through the following description and accompanying drawings, wherein:

DETAILED DESCRIPTION OF THE PREFERRED EMBODIMENTS

Figure 1:
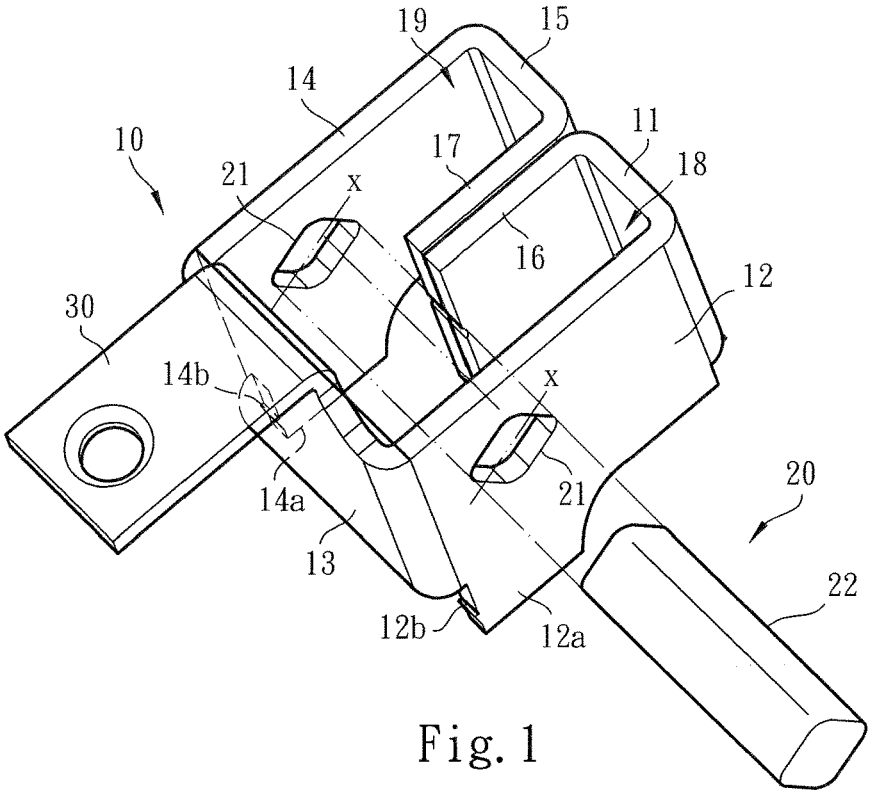
FIG. 1 is a perspective view of the electrical contact limiter structure of the present invention, showing the structures of the limiter and the limitation mechanism.

Please refer to FIG. 1. The electrical contact limiter structure of wire connection terminal of the present invention includes a limiter 10 and a limitation mechanism 20 assembled with the limiter 10. The limiter 10 and the limitation mechanism 20 are mountable in an insulation case and assembled with a conductive support, an electrical contact and a metal leaf spring to form a pushbutton switch device, electrical connection terminal or the like device for pivotally connecting with a wiring circuit or conductive wire coming from an electronic or electrical apparatus. (This pertains to prior art and thus is not shown in the drawings). Basically, according to the application form or mode, the limiter 10 defines at least one (internal) space to permit at least one conductive wire to plug in and assemble with the metal leaf spring.

In a preferred embodiment, the limiter 10 is selectively made of a flat blank material with higher rigidity or hardness, such as iron, steel, etc. The flat blank material is processed to form a rectangular frame structure of the limiter 10 as shown in FIG. 1.

As shown in the drawings, the limiter 10 includes a first side 11, a second side 12 connected with the first side 11, a third side 13 connected with the second side 12 and a fourth side 14 connected with the third side 13. The first side 11 is bent toward the third side 13 to form a first subsidiary side 16. (For example, the first side 11 and the first subsidiary side 16 can contain an acute angle, a right angle or an obtuse angle) to define a first space 18.

As shown in the drawings, the fourth side 14 is bent toward the second side 12 and extends to form a fifth side 15. The fifth side 15 and the first side 11 are positioned on the same plane face. The fifth side 15 is bent toward the third side 13 and extends to forma second subsidiary side 17. (For example, the fifth side 15 and the second subsidiary side 17 can contain an acute angle, a right angle or an obtuse angle) to define a second space 19. The first and second subsidiary sides 16, 17 are side by side arranged in parallel to each other. The lengths of the first and second subsidiary sides 16, 17 are respectively smaller than the lengths of the second and fourth sides 12, 14 (or the lengths of the first and second subsidiary sides 16, 17 are respectively larger than or equal to ½ of the lengths of the second and fourth sides 12, 14), whereby the first space 18 communicates with the second space 19. The first and second spaces 18, 19 together or respectively receive and assemble with the metal leaf spring, whereby the metal leaf spring can swing within the limiter 10 (or the first and second spaces 18, 19) to securely hold the conductive wire.

Figure 1A:
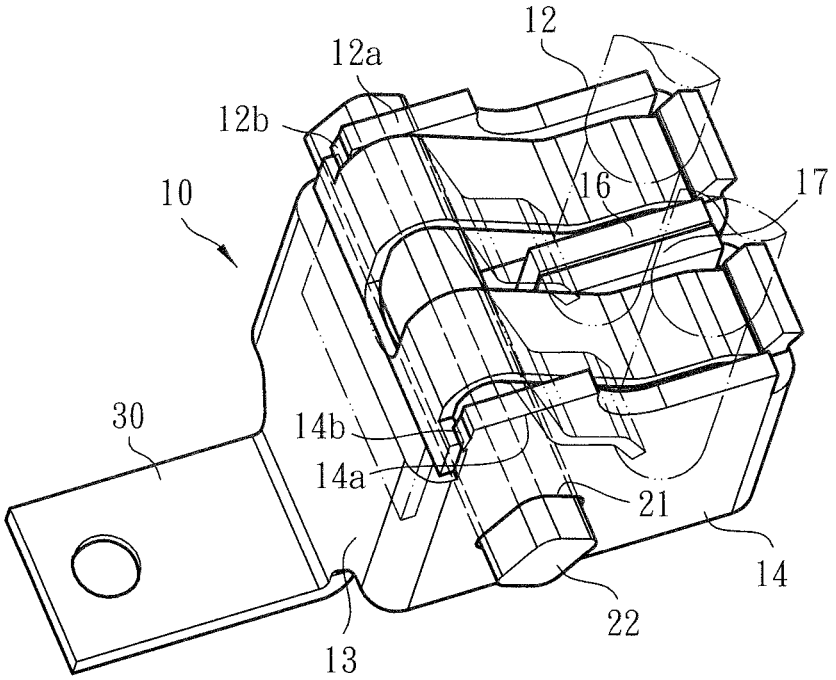
FIG. 1A is a perspective view of the electrical contact limiter structure depicted in FIG. 1 from an opposing angle, additionally depicting a metal leaf spring and possible positioning of conductive wires.

In a conventional metal leaf spring structure, the metal leaf spring has the form of a forked structure with two leg sections for respectively pressing two conductive wires plugged into the limiter 10. Therefore, in this embodiment, at least the second side 12 and the first subsidiary side 16 and the fourth side 14 and the second subsidiary side 17 respectively help in restricting the moving path of the two leg sections of the metal leaf spring, as depicted for example in FIG. 1A.

Also, as shown in FIG. 1, an upper end of the third side 13 of the limiter 10 is (perpendicularly) bent to form an extension section 30. The extension section 30 can selectively electrically contact the other components of the switch device or the electrical connection terminal to close the circuit or non-contact with the other components to open the circuit.

Figure 1B:
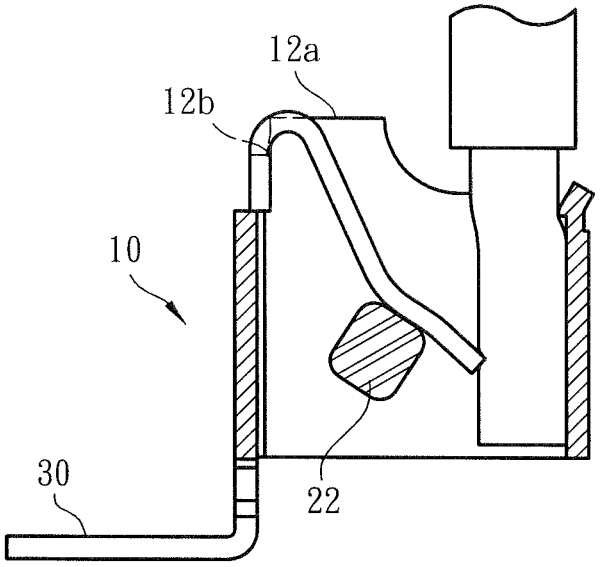
FIG. 1B is a cut-away view of the electrical contact limiter structure depicted in FIG. 1 from a side angle, additionally depicting a metal leaf spring and a conductive wire.

In this embodiment, the limitation mechanism 20 includes assembling sections 21 at least disposed on the second and fourth sides 12, 14 of the limiter 10 and a stopper body 22 disposed on the assembling sections 21. The stopper body 22 is a bolt body with a cross section of quadrangular configuration. The stopper body 22 is detachably transversely passed through the limiter 10 (or the first and second spaces 18, 19) and fitted with the assembling sections 21 for restricting the moving range or bending angle of the metal leaf spring. Therefore, when an external operational force is applied to the metal leaf spring, the metal leaf spring is prevented from being over-bent to cause material fatigue or breakage, as depicted for example in FIG. 1B.

As shown in the drawings, the assembling sections 21 have the form of perforation structure and are positioned on the second and fourth sides 12, 14 closer to the third side 13. In addition, the assembling sections 21 are arranged by an inclination angle. With the reference axis X of the drawing as a reference basis, the assembling sections 21 are arranged by such an inclination angle that the assembling sections 21 are downward inclined from the first side 11 or the fifth side 15 toward the third side 13. As depicted for example in FIGS. 1A and 1B, after the stopper body 22 is assembled with the assembling sections 21 in the inclined form, when an operator operates to press down and bend the metal leaf spring, the metal leaf spring is leant against the plane face section of the stopper body 22. This not only can minimize the possibility of over-bending of the metal leaf spring, but also is beneficial to the pressing/leaning cooperation between the metal leaf spring and the stopper body 22.

Figure 2A:
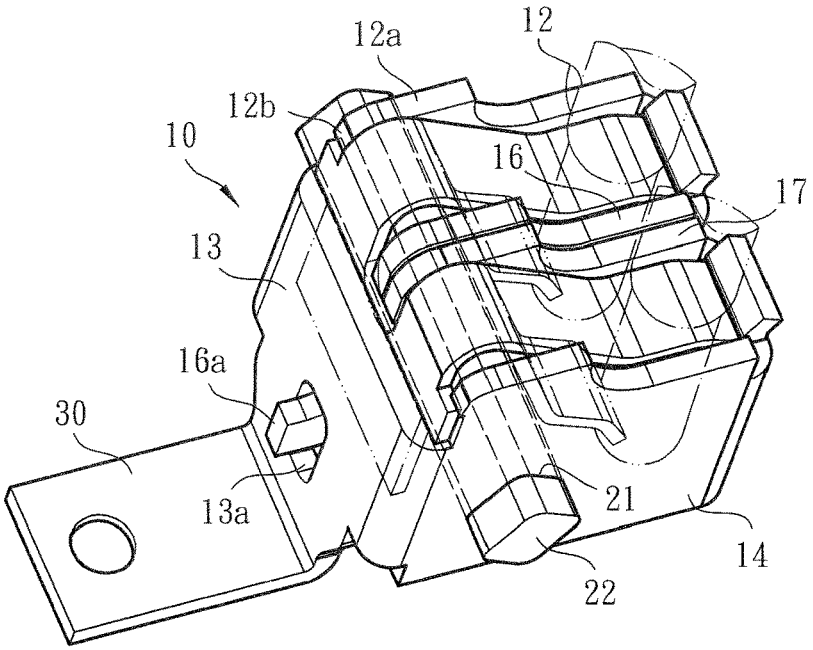
FIG. 2A is a perspective view of the electrical contact limiter structure depicted in FIG. 2 from an opposing angle, additionally depicting a metal leaf spring and possible positioning of conductive wires.
Figure 3A:
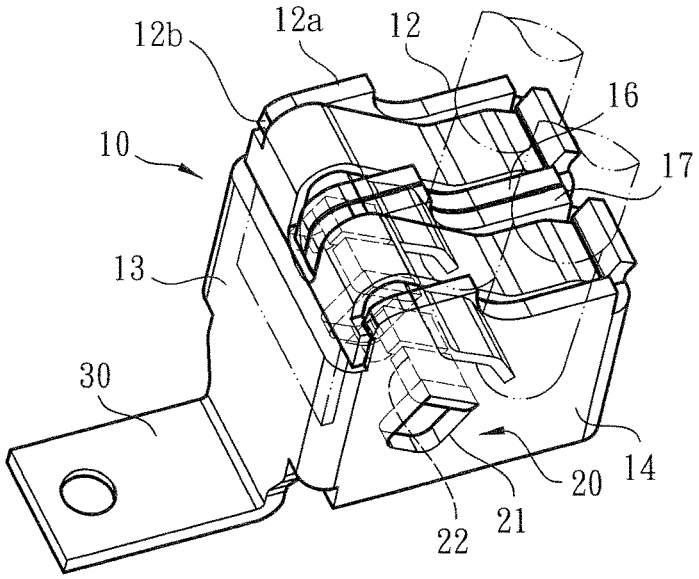
FIG. 3A is a perspective view of the electrical contact limiter structure depicted in FIG. 3 from an opposing angle, additionally depicting a metal leaf spring and possible positioning of conductive wires.

In a preferred embodiment, leg sections 12*a*, 14*a* protrude from the bottom ends or bottom sections of the second and fourth sides 12, 14 of the limiter 10. In addition, finger sections 12*b*, 14*b* are formed on (lateral sides) of the leg sections 12*a*, 14*a*. The finger sections 12*b*, 14*b* help in securely assembling the limiter 10 with the metal leaf springs (or the conductive support, electrical contact, etc.), as depicted for example in FIG. 1A. Certain possible placements of the metal leaf springs in other exemplary embodiments are depicted in FIGS. 2A, 3A, and 12A, although the invention is not limited thereto.

Figure 2:
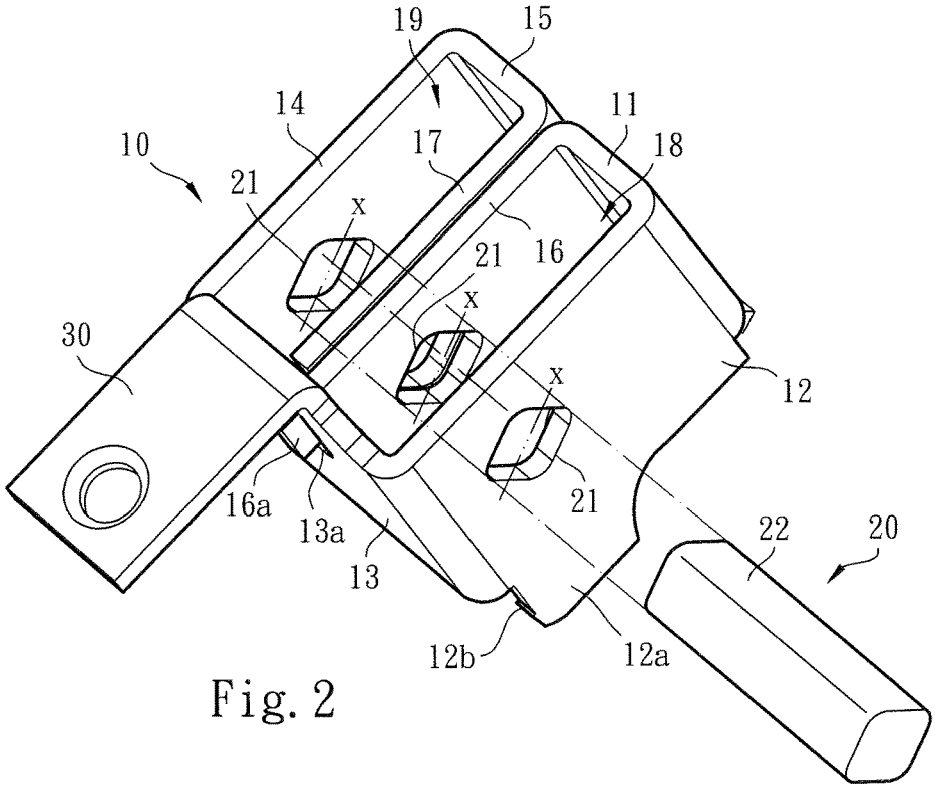
FIG. 2 is a perspective view of another embodiment of the electrical contact limiter structure of the present invention, showing that the first subsidiary side or the second subsidiary side extends through the third side and the structure of the limitation mechanism.

Please refer to FIG. 2. The third side 13 is formed with a window 13*a* and the first subsidiary side 16 (and/or the second subsidiary side 17) is formed with a protrusion end 16*a*. The total length of the first subsidiary side 16 and the protrusion end 16*a* is larger than the length of the second subsidiary side 17. Therefore, the protrusion end 16*a* can extend into or pass through the window 13*a*. In this case, the window 13*a* can restrict and bear the first subsidiary side 16 (and/or the second subsidiary side 17) to form a stable structure without deflection. Accordingly, in the operation process, the metal leaf springs will not deflect or shake so as to together truly restrict the moving path of the metal leaf springs.

Figure 3:
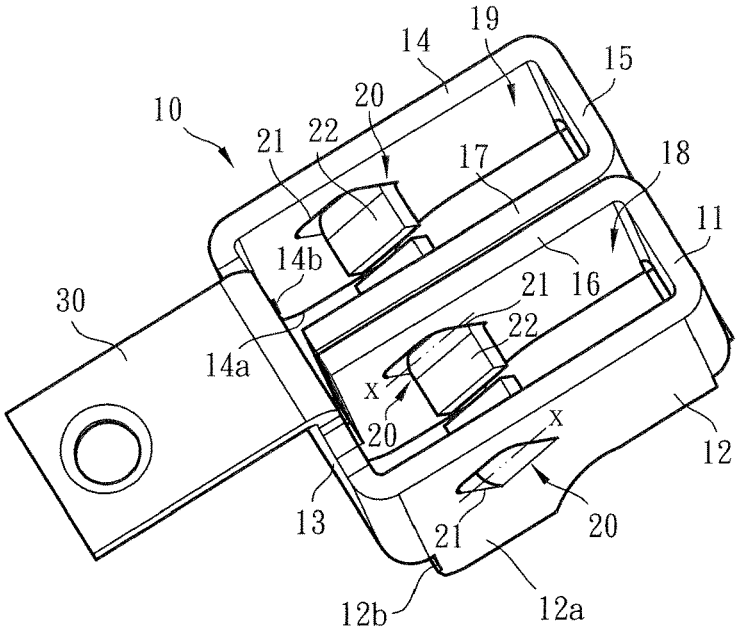
FIG. 3 is a perspective view of still another embodiment of the electrical contact limiter structure of the present invention, showing that the first and second subsidiary sides extend to a position in adjacency to the third side and the structure of the limitation mechanism.

As shown in FIGS. 2 and 3, the first subsidiary side 16 of the limiter extends to a position in adjacency to the third side 13 so as to define the first space 18 with a fully closed periphery. The second subsidiary side 17 extends to a position in adjacency to the third side 13 so as to define the second space 19 with a fully closed periphery. In addition, at least the second side 12 and the first subsidiary side 16 help in restricting the moving path of one metal leaf spring and the fourth side 14 and the second subsidiary side 17 help in restricting the moving path of another metal leaf spring.

FIG. 3 shows that the length of the first subsidiary side 16 is equal to the length of the second subsidiary side 17. Also, in a modified embodiment as shown in FIG. 3, the limitation mechanism 20 at least includes the assembling sections 21 formed on the second and the fourth sides 12, 14 and the stopper bodies 22 disposed on the assembling sections 21. The stopper bodies 22 are plate structures (transversely) extending and protruding from the assembling sections 21 toward the interior of the limiter 10 or the first and second spaces 18, 19.

As shown in FIG. 3, corresponding to the assembling sections 21 formed on the second and the fourth sides 12, 14 and the stopper bodies 22 disposed on the assembling sections 21, the first and second subsidiary sides 16, 17 are respectively formed with assembling sections 21 and stopper bodies, which are plate structures extending and protruding from the assembling sections 21 toward the first and second spaces 18, 19.

In a preferred embodiment as shown in FIG. 3, the assembling sections 21 and the stopper bodies 22 of the second and fourth sides 12, 14 and/or the first and second subsidiary sides 16, 17 are also arranged by an inclination angle. With the reference axis X of the drawing as a reference basis, the stopper bodies 22 (and/or the assembling sections 21) are arranged by such an inclination angle that the stopper bodies 22 (and/or the assembling sections 21) are downward inclined from the first side 11 or the fifth side 15 toward the third side 13.

It should be noted that the stopper bodies 22 are arranged in an inclined form, whereby when an operator operates to press down and bend the metal leaf spring, the metal leaf spring is leant against the plane face section of the stopper body 22. This not only can minimize the possibility of over-bending of the metal leaf spring, but also is beneficial to the pressing/leaning cooperation between the metal leaf spring and the stopper body 22.

As shown in FIG. 3, the plate structures of the stopper bodies 22 can be formed by means of punching. In a preferred embodiment, the stopper bodies 22 of the limitation mechanism 20 can be directly disposed on the second and fourth sides 12, 14 and/or the first and second subsidiary sides 16, 17. Alternatively, the stopper bodies 22 can be disposed on the second and fourth sides 12, 14 and/or the first and second subsidiary sides 16, 17 by means of adhesion.

Figure 4:
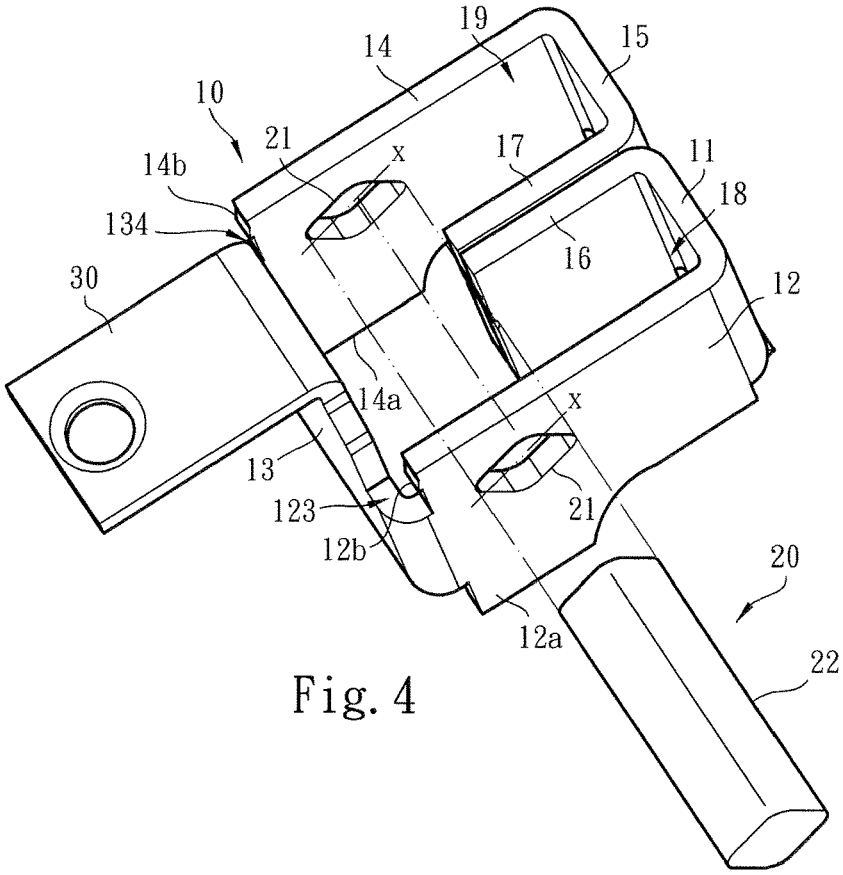
FIG. 4 is a perspective view of a modified embodiment of FIG. 1, showing that a notch is formed at a junction between the second and third sides and another notch is formed at a junction between the third and fourth sides.
Figure 5:
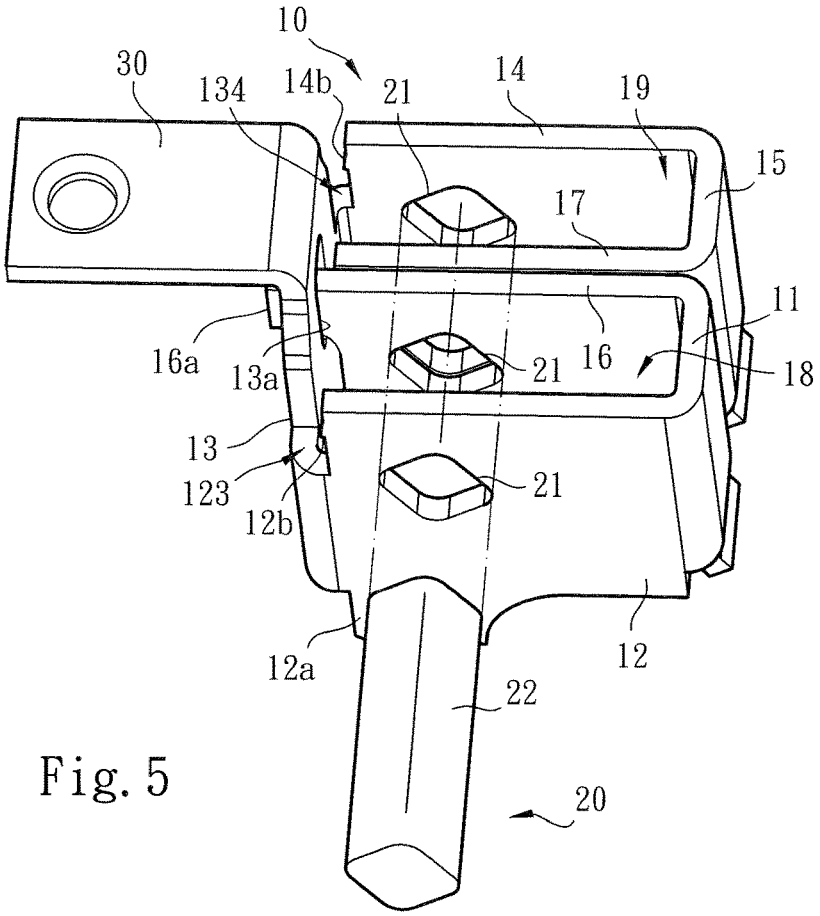
FIG. 5 is a perspective view of a modified embodiment of FIG. 2, showing that a notch is formed at a junction between the second and third sides and another notch is formed at a junction between the third and fourth sides.
Figure 6:
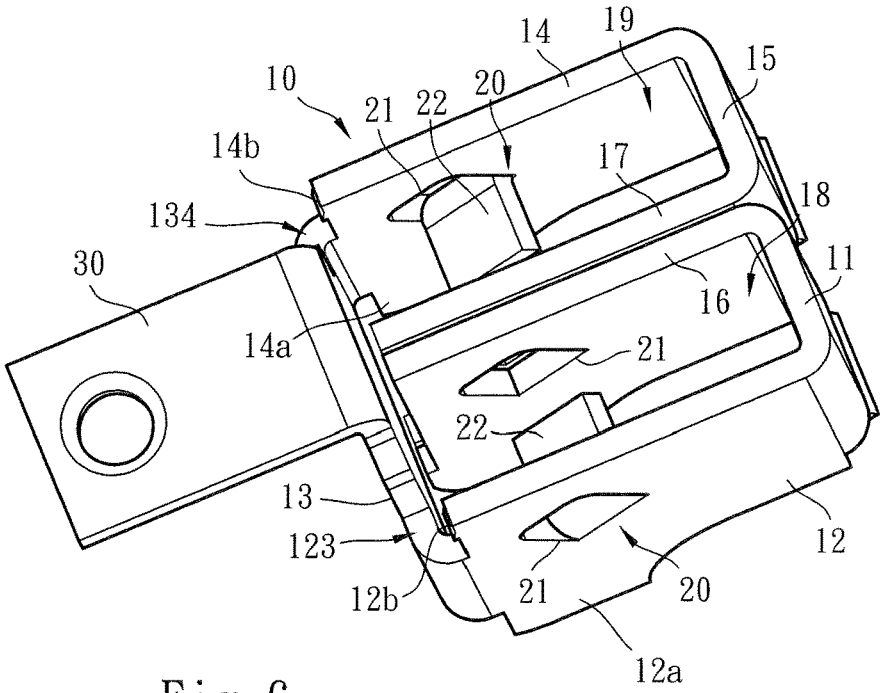
FIG. 6 is a perspective view of a modified embodiment of FIG. 3, showing that a notch is formed at a junction between the second and third sides and another notch is formed at a junction between the third and fourth sides.

Please now refer to FIGS. 4, 5 and 6. FIG. 4 shows a modified embodiment of FIG. 1. FIG. 5 shows a modified embodiment of FIG. 2. FIG. 6 shows a modified embodiment of FIG. 3. As shown in the drawings, in the limiter 10, a notch 123 is formed at a junction between (the upper end) of the second side 12 and (the upper end) of the third side 13 and a notch 134 is formed at a junction between the third side 13 and the fourth side 14. The notches 123, 124 serve to help in securely assembling the limiter 10 with the metal leaf springs. FIG. 4 also shows that the finger sections 12*b*, 14*b* are respectively formed on the lateral side of the upper end of the second side 12 in a position adjacent to the notch 123 and the lateral side of the upper end of the fourth side 14 in a position adjacent to the notch 134. The finger sections 12*b*, 14*b* serve to cooperate with the notches 123, 134 to securely assemble with the metal leaf springs.

FIG. 6 also shows that the second and fourth sides 12, 14 are formed with the assembling sections 21 and the stopper bodies 22. The stopper bodies 22 are plate structures (transversely) extending and protruding from the assembling sections 21 toward the interior of the limiter 10 or the first and second spaces 18, 19. In addition, the first and second subsidiary sides 16, 17 are formed with the assembling sections 21.

Figure 7:
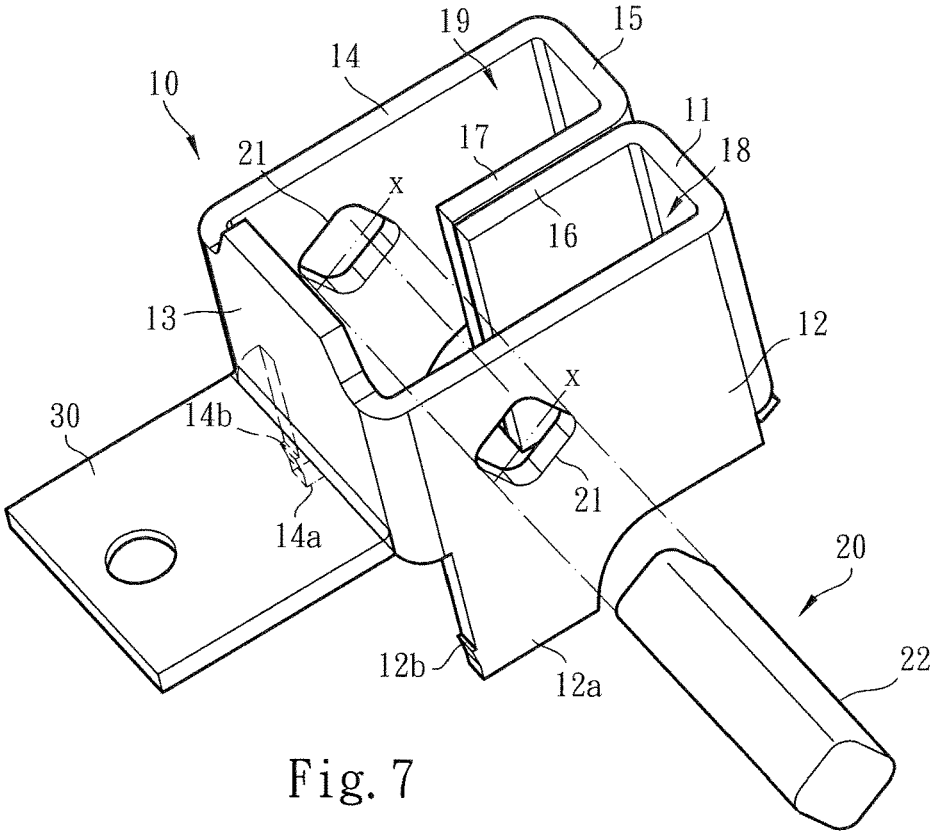
FIG. 7 is a perspective view of the electrical contact limiter structure of the present invention, showing that the bottom end of the third side is formed with an extension section.
Figure 8:
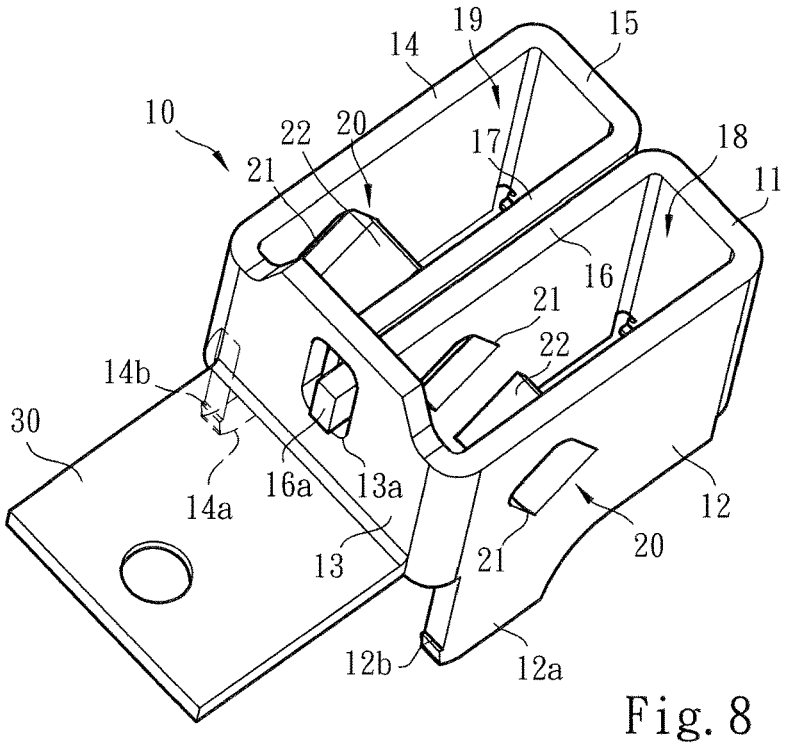
FIG. 8 is a perspective view of another embodiment of the electrical contact limiter structure of the present invention, showing that the first subsidiary side or the second subsidiary side extends through the third side and the structure of the limitation mechanism.

Please now refer to FIGS. 7 and 8. In a preferred embodiment, leg sections 12*a*, 14*a* are formed at the bottom ends of the second and fourth sides 12, 14 of the limiter 10. In addition, finger sections 12*b*, 14*b* are formed on (lateral sides) of the leg sections 12*a*, 14*a*. Also, the bottom end of the third side 13 is (perpendicularly) bent to form the extension section 30.

Referring to FIGS. 7 and 8, the lengths or positions of the first and second subsidiary sides 16, 17 are respectively identical to what are shown in FIGS. 1 and 2. FIG. 8 also shows that the second and fourth sides 12, 14 are formed with the assembling sections 21 and the stopper bodies 22 in the form of the plate structures. In addition, the first and second subsidiary sides 16, 17 are formed with the assembling sections 21.

Figure 9:
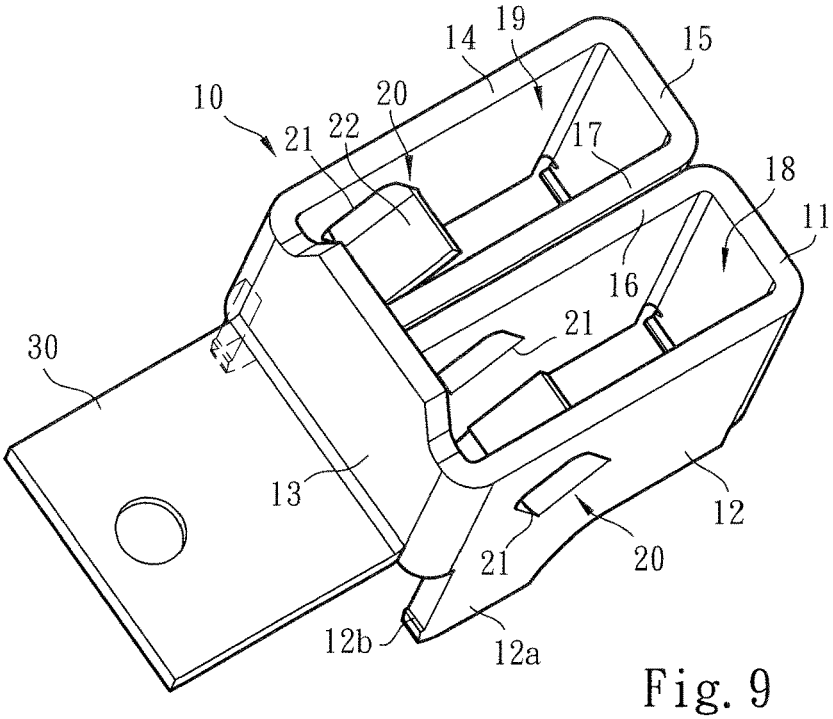
FIG. 9 is a perspective view of still another embodiment of the electrical contact limiter structure of the present invention, showing that the first and second subsidiary sides extend to a position in adjacency to the third side and the structure of the limitation mechanism.

FIG. 9 shows that the second and fourth sides 12, 14 are formed with the assembling sections 21 and the stopper bodies 22 in the form of the plate structures. The first subsidiary side 16 extends to a position in adjacency to the third side 13 so as to define the first space 18 with a fully closed periphery. The second subsidiary side 17 extends to a position in adjacency to the third side 13 so as to define the second space 19 with a fully closed periphery. In addition, the first and second subsidiary sides 16, 17 are formed with the assembling sections 21.

Figure 10:
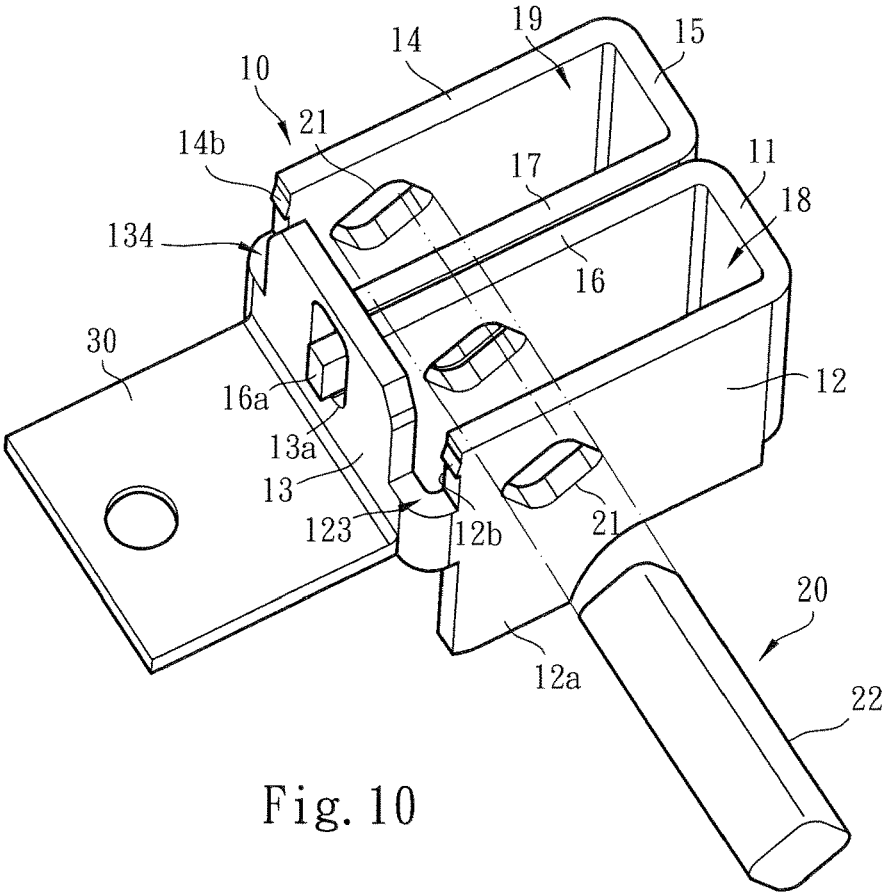
FIG. 10 is a perspective view of a preferred embodiment of the electrical contact limiter structure of the present invention, showing that the first subsidiary side or the second subsidiary side extends through the third side and the structure of the limitation mechanism and a notch is formed at a junction between the second and third sides and another notch is formed at a junction between the third and fourth sides.

Please refer to FIG. 10. The bottom end of the third side 13 is (perpendicularly) bent to form the extension section 30. The third side 13 is formed with a window 13*a* to assemble with the protrusion end 16*a* of the first subsidiary side 16. In addition, a notch 123 is formed at a junction between (the upper end) of the second side 12 and (the upper end) of the third side 13 and a notch 134 is formed at a junction between the third side 13 and the fourth side 14. The finger sections 12*b*, 14*b* are respectively formed on the lateral side of the upper end of the second side 12 in a position adjacent to the notch 123 and the lateral side of the upper end of the fourth side 14 in a position adjacent to the notch 134.

Figure 11:
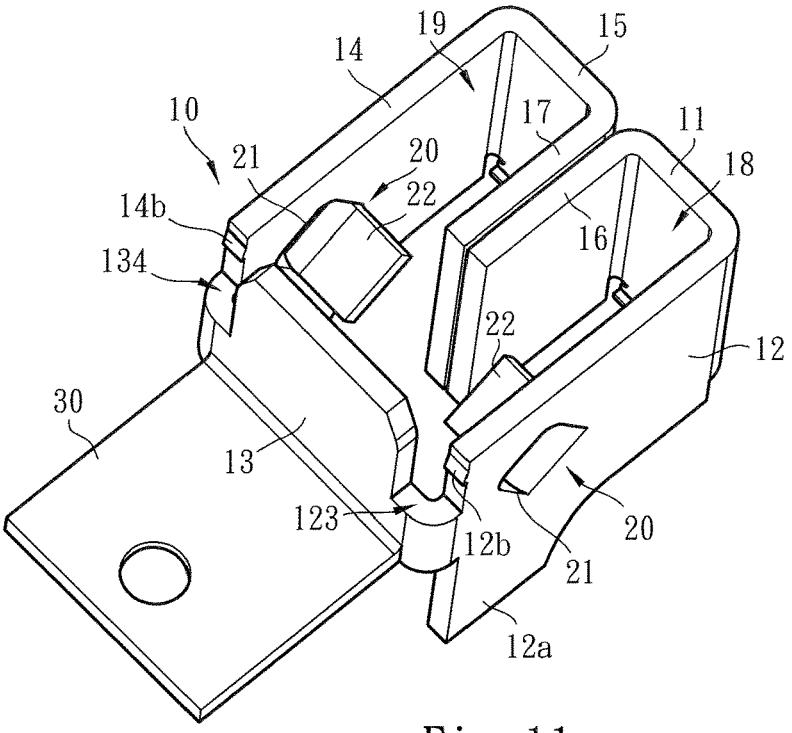
FIG. 11 is a perspective view of a modified embodiment of FIG. 7, showing the limitation mechanism and that a notch is formed at a junction between the second and third sides and another notch is formed at a junction between the third and fourth sides.

FIG. 11 shows that the second and fourth sides 12, 14 are formed with the assembling sections 21 and the stopper bodies 22 in the form of the plate structures. In addition, in the limiter 10, a notch 123 is formed at a junction between (the upper end) of the second side 12 and (the upper end) of the third side 13 and a notch 134 is formed at a junction between the third side 13 and the fourth side 14. The finger sections 12*b*, 14*b* are respectively formed on the lateral side of the upper end of the second side 12 in a position adjacent to the notch 123 and the lateral side of the upper end of the fourth side 14 in a position adjacent to the notch 134.

FIG. 11 shows that the lengths or positions of the first and second subsidiary sides 16, 17 are identical to what are shown in FIGS. 1, 4 and 7.

Figure 12:
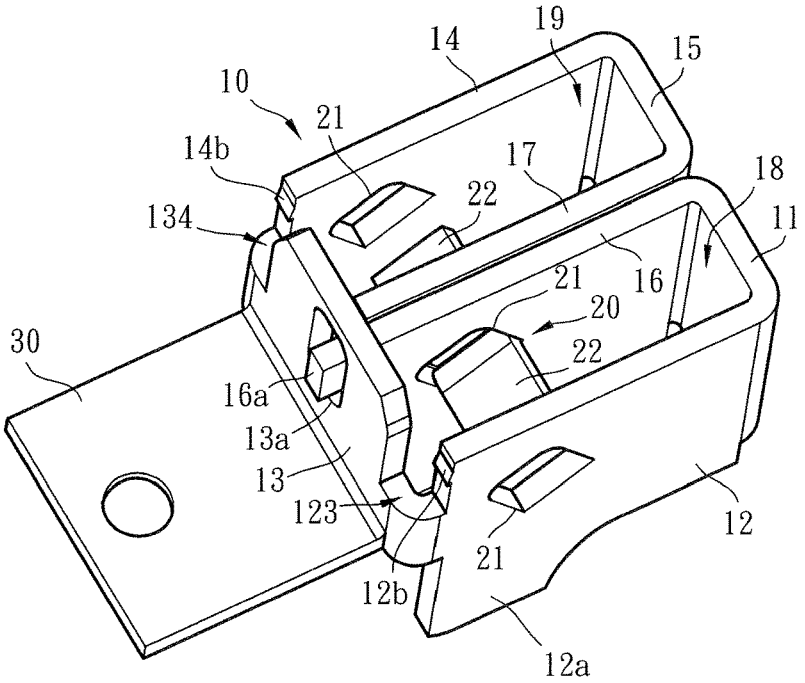
FIG. 12 is a perspective view of a modified embodiment of FIG. 8, showing the limitation mechanism and that a notch is formed at a junction between the second and third sides and another notch is formed at a junction between the third and fourth sides.
Figure 12A:
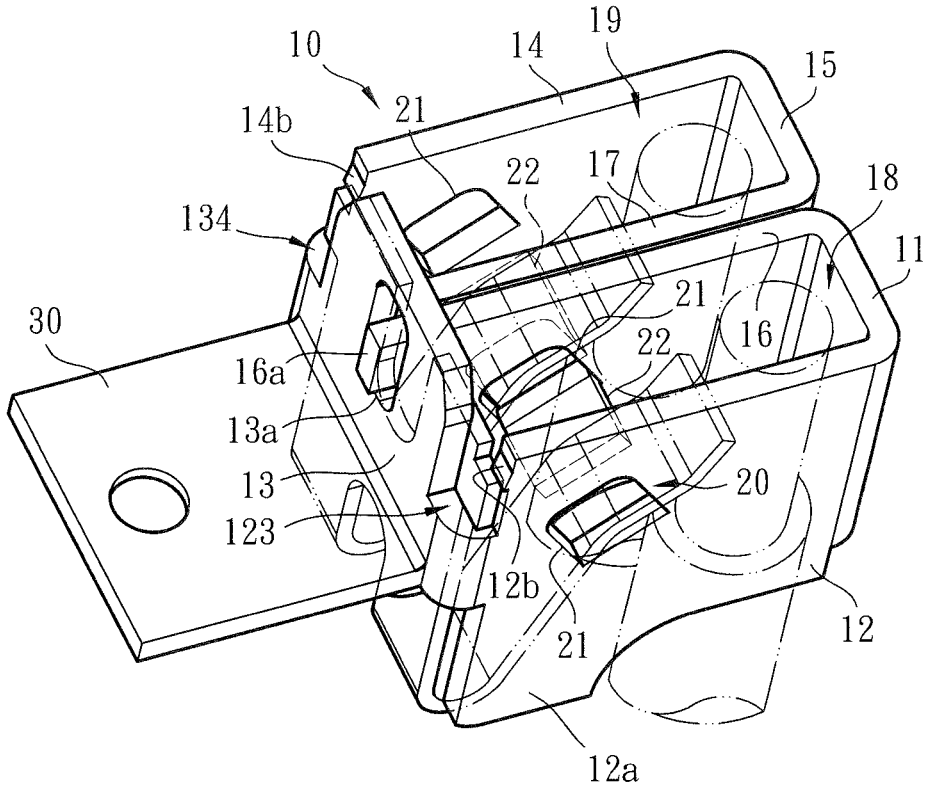
FIG. 12A is the perspective view of the electrical contact limiter structure depicted in FIG. 12, additionally depicting a metal leaf spring and possible positioning of conductive wires.

Please refer to FIG. 12. The first and second subsidiary sides 16, 17 are formed with the assembling sections 21 and the stopper bodies 22 in the form of the plate structures. The protrusion end 16*a* of the first subsidiary side 16 passes through the window 13*a* of the third side to define the first space 18 with a fully closed periphery. The second subsidiary side 17 extends to a position in adjacency to the third side 13 so as to define the second space 19 with a fully closed periphery. In addition, in the limiter 10, a notch 123 is formed at a junction between (the upper end) of the second side 12 and (the upper end) of the third side 13 and a notch 134 is formed at a junction between the third side 13 and the fourth side 14. The finger sections 12*b*, 14*b* are respectively formed on the lateral side of the upper end of the second side 12 in a position adjacent to the notch 123 and the lateral side of the upper end of the fourth side 14 in a position adjacent to the notch 134. FIG. 12 also shows that the second and fourth sides 12, 14 are formed with the assembling sections 21.

Figure 13:
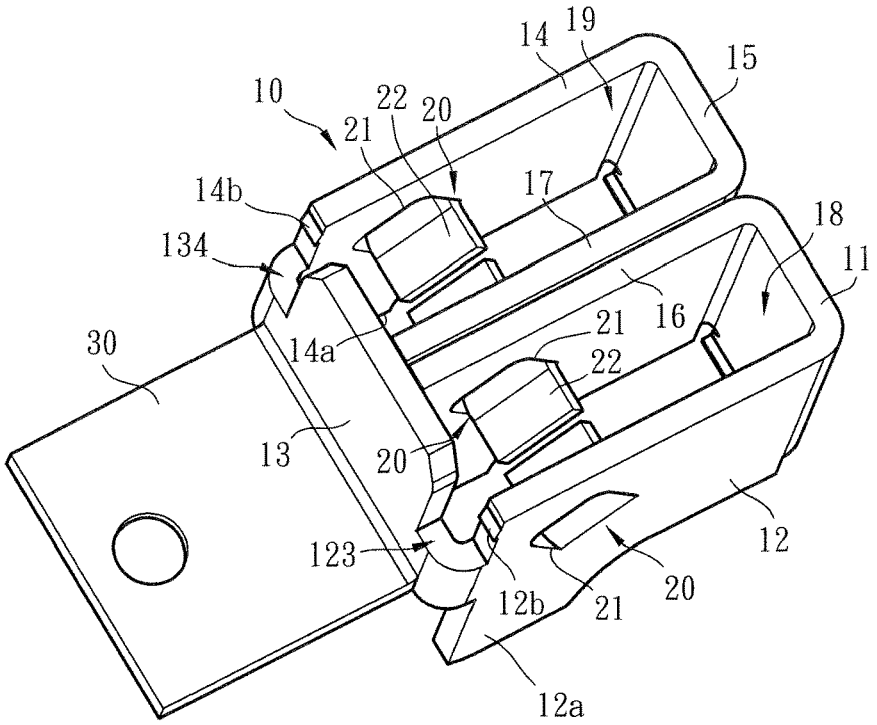
FIG. 13 is a perspective view of a modified embodiment of FIG. 9, showing the limitation mechanism and that a notch is formed at a junction between the second and third sides and another notch is formed at a junction between the third and fourth sides.

FIG. 13 shows that the second and fourth sides 12, 14 and the first and second subsidiary sides 16, 17 are formed with the assembling sections 21 and the stopper bodies 22 in the form of the plate structures. The first subsidiary side 16 extends to a position in adjacency to the third side 13 so as to define the first space 18 with a fully closed periphery. The second subsidiary side 17 extends to a position in adjacency to the third side 13 so as to define the second space 19 with a fully closed periphery. In addition, in the limiter 10, a notch 123 is formed at a junction between (the upper end) of the second side 12 and (the upper end) of the third side 13 and a notch 134 is formed at a junction between the third side 13 and the fourth side 14. The finger sections 12*b*, 14*b* are respectively formed on the lateral side of the upper end of the second side 12 in a position adjacent to the notch 123 and the lateral side of the upper end of the fourth side 14 in a position adjacent to the notch 134.

Figure 14:
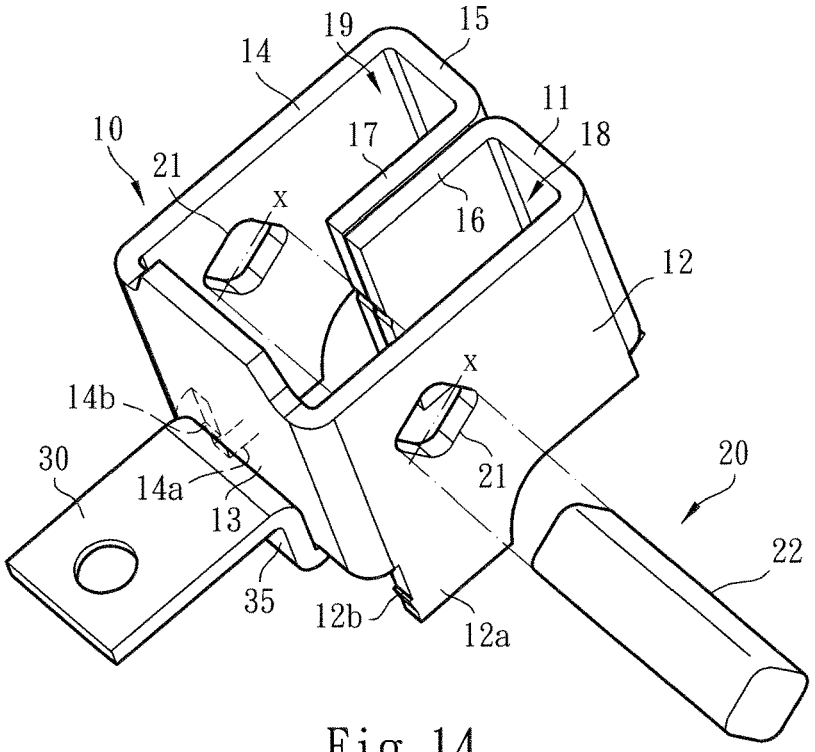
FIG. 14 is a perspective view of a preferred embodiment of the electrical contact limiter structure of the present invention, showing that the bottom end of the third side is formed with a subsidiary section and an extension section.
Figure 15:
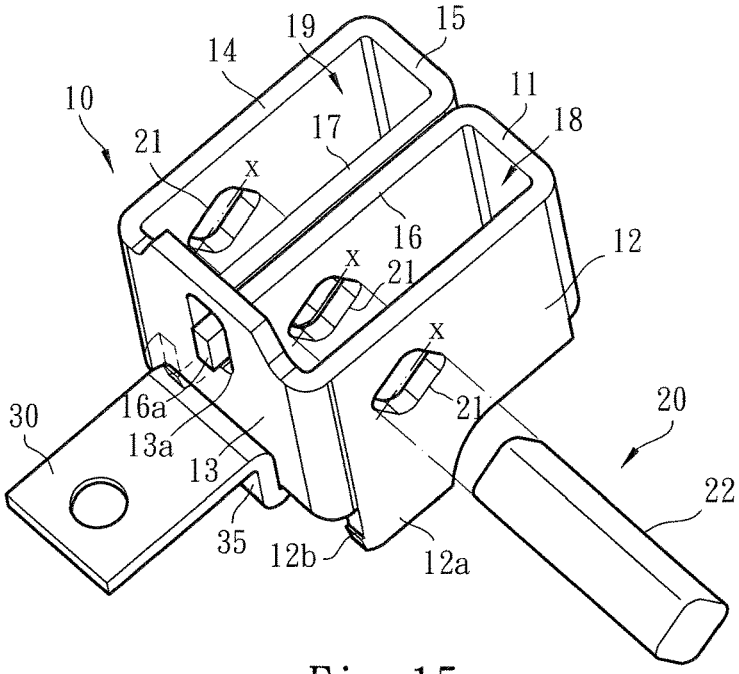
FIG. 15 is a perspective view of another embodiment of the electrical contact limiter structure of the present invention, showing that the first subsidiary side or the second subsidiary side extends through the third side and the structure of the limitation mechanism.

Please refer to FIGS. 14 and 15. In a modified embodiment of FIGS. 1 and 2, the bottom end of the third side 13 of the limiter is bent toward the upper side of the drawing to form a subsidiary section 35. The subsidiary section 35 is further bent to a horizontal position and extends to form the extension section 30.

Figure 16:
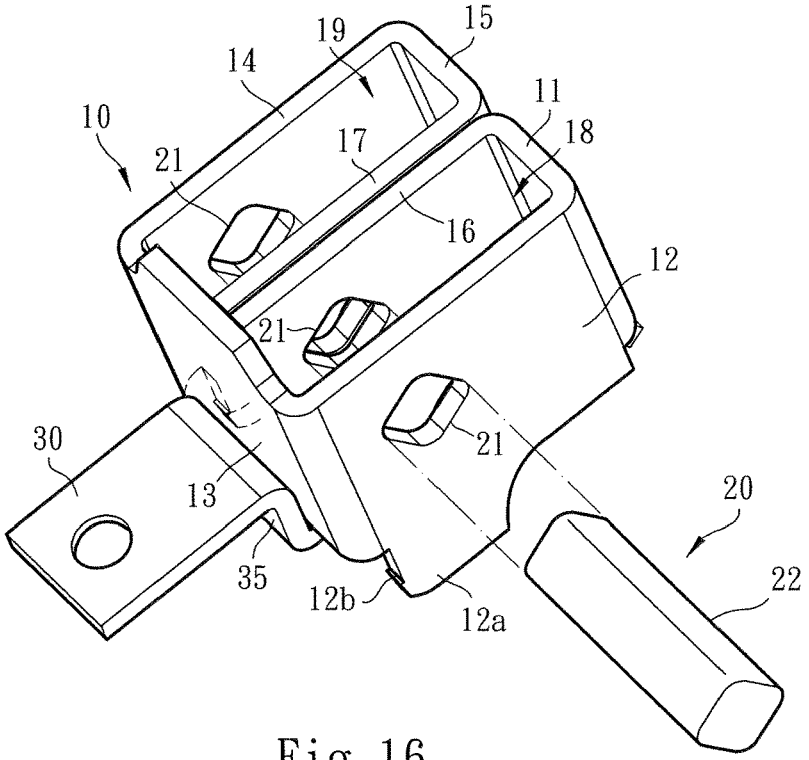
FIG. 16 is a perspective view of still another embodiment of the electrical contact limiter structure of the present invention, showing that the first and second subsidiary sides extend to a position in adjacency to the third side and the structure of the limitation mechanism.

FIG. 16 shows that the second and fourth sides 12, 14 and the first and second subsidiary sides 16, 17 are formed with the assembling sections 21 and the stopper body 22 in the form of a bolt body is assembled with the assembling sections 21. The first subsidiary side 16 extends to a position in adjacency to the third side 13 so as to define the first space 18 with a fully closed periphery. The second subsidiary side 17 extends to a position in adjacency to the third side 13 so as to define the second space 19 with a fully closed periphery. In addition, the bottom end of the third side 13 of the limiter is bent toward the upper side of the drawing to form a subsidiary section 35. The subsidiary section 35 is further bent to a horizontal position and extends to form the extension section 30.

Figure 17:
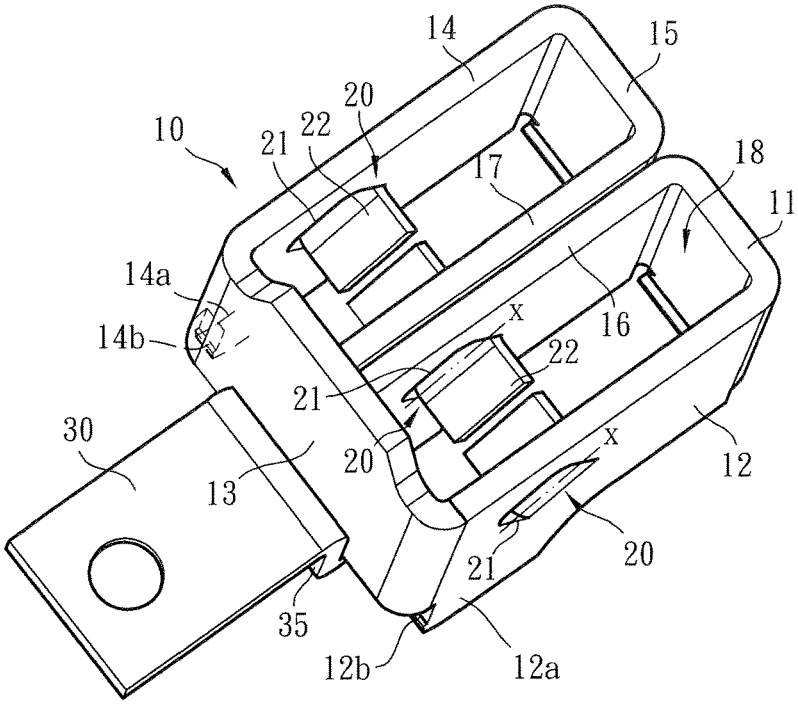
FIG. 17 is a perspective view of a preferred embodiment of the electrical contact limiter structure of the present invention, showing that the first and second subsidiary sides extend to a position in adjacency to the third side and the structure of the limitation mechanism.

FIG. 17 shows that the second and fourth sides 12, 14 and the first and second subsidiary sides 16, 17 are formed with the assembling sections 21 and the stopper bodies 22 in the form of the plate structures. The first subsidiary side 16 extends to a position in adjacency to the third side 13 so as to define the first space 18 with a fully closed periphery. The second subsidiary side 17 extends to a position in adjacency to the third side 13 so as to define the second space 19 with a fully closed periphery. In addition, the bottom end of the third side 13 of the limiter is bent toward the upper side of the drawing to form a subsidiary section 35. The subsidiary section 35 is further bent to a horizontal position and extends to form the extension section 30.

Figure 18:
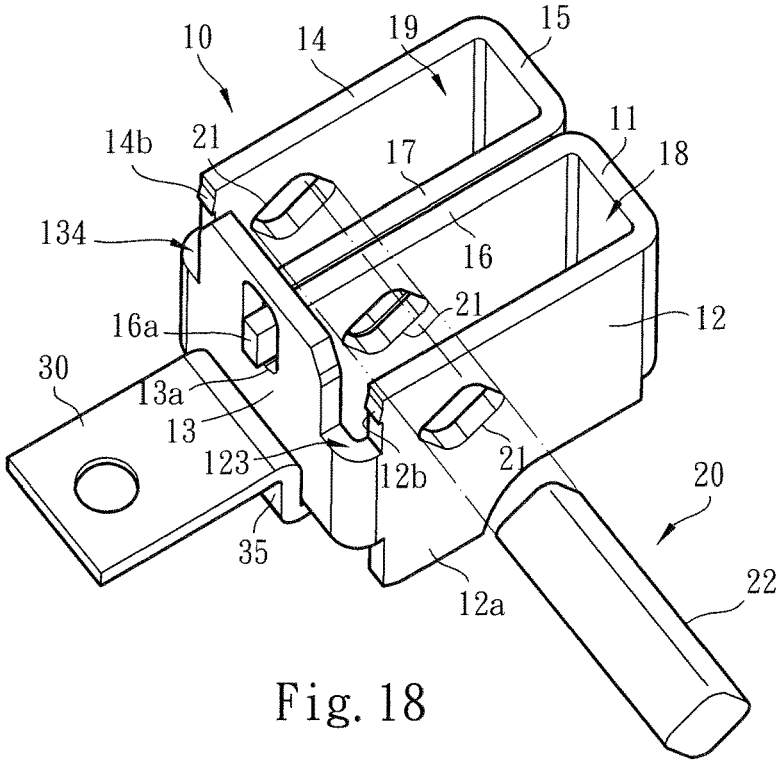
FIG. 18 is a perspective view of a modified embodiment of FIG. 14, showing the limitation mechanism and that a notch is formed at a junction between the second and third sides and another notch is formed at a junction between the third and fourth sides.

FIG. 18 shows a modified embodiment of FIG. 14. According to this embodiment, in the limiter 10, a notch 123 is formed at a junction between (the upper end) of the second side 12 and (the upper end) of the third side 13 and a notch 134 is formed at a junction between the third side 13 and the fourth side 14. The finger sections 12*b*, 14*b* are respectively formed on the lateral side of the upper end of the second side 12 in a position adjacent to the notch 123 and the lateral side of the upper end of the fourth side 14 in a position adjacent to the notch 134.

Figure 19:
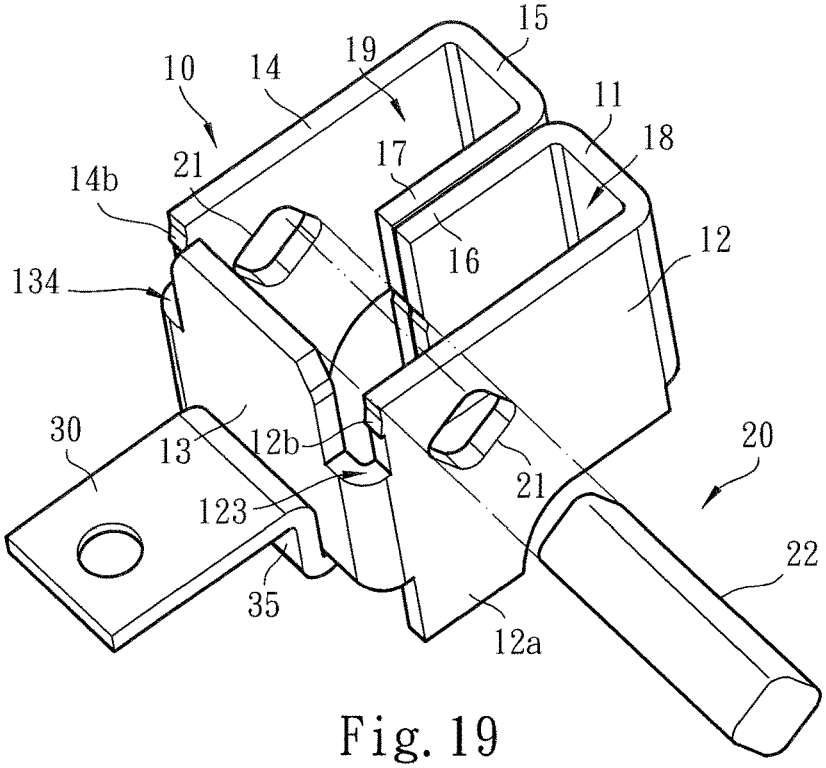
FIG. 19 is a perspective view of a modified embodiment of FIG. 15, showing the limitation mechanism and that a notch is formed at a junction between the second and third sides and another notch is formed at a junction between the third and fourth sides.

FIG. 19 shows a modified embodiment of FIG. 15. According to this embodiment, in the limiter 10, a notch 123 is formed at a junction between (the upper end) of the second side 12 and (the upper end) of the third side 13 and a notch 134 is formed at a junction between the third side 13 and the fourth side 14. The finger sections 12*b*, 14*b* are respectively formed on the lateral side of the upper end of the second side 12 in a position adjacent to the notch 123 and the lateral side of the upper end of the fourth side 14 in a position adjacent to the notch 134.

Figure 20:
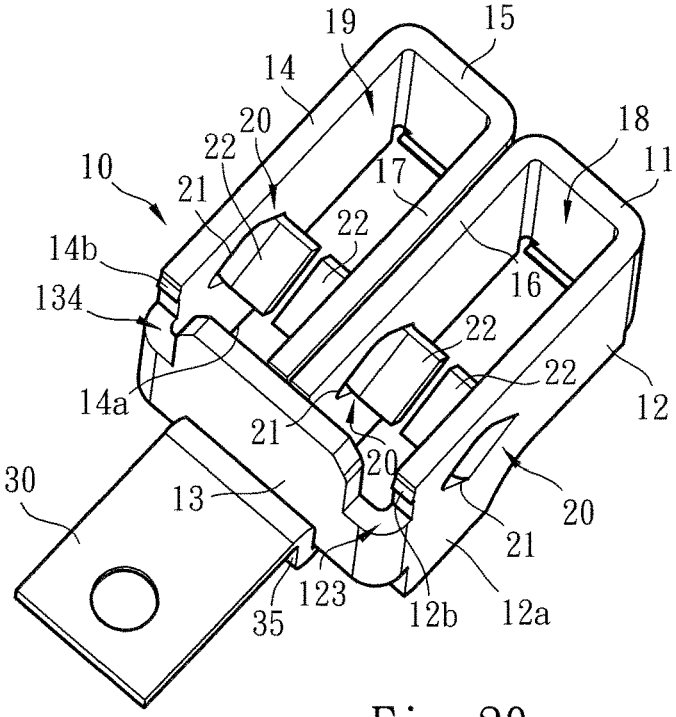
FIG. 20 is a perspective view of a modified embodiment of FIG. 19, showing the limitation mechanism and that a notch is formed at a junction between the second and third sides and another notch is formed at a junction between the third and fourth sides.

FIG. 20 shows a modified embodiment of FIG. 19. According to this embodiment, the second and fourth sides 12, 14 and the first and second subsidiary sides 16, 17 are formed with the assembling sections 21 and the stopper bodies 22 in the form of the plate structures.

Figure 21:
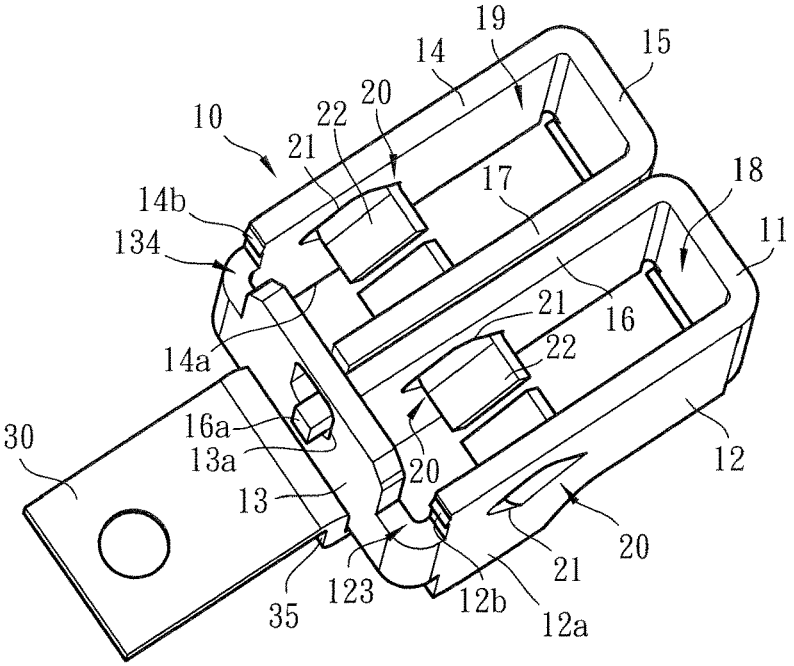
FIG. 21 is a perspective view of a modified embodiment of FIG. 17, showing the limitation mechanism and that a notch is formed at a junction between the second and third sides and another notch is formed at a junction between the third and fourth sides.

FIG. 21 shows a modified embodiment of FIG. 17. According to this embodiment, in the limiter 10, a notch 123 is formed at a junction between (the upper end) of the second side 12 and (the upper end) of the third side 13 and a notch 134 is formed at a junction between the third side 13 and the fourth side 14. The finger sections 12*b*, 14*b* are respectively formed on the lateral side of the upper end of the second side 12 in a position adjacent to the notch 123 and the lateral side of the upper end of the fourth side 14 in a position adjacent to the notch 134.

Figure 22:
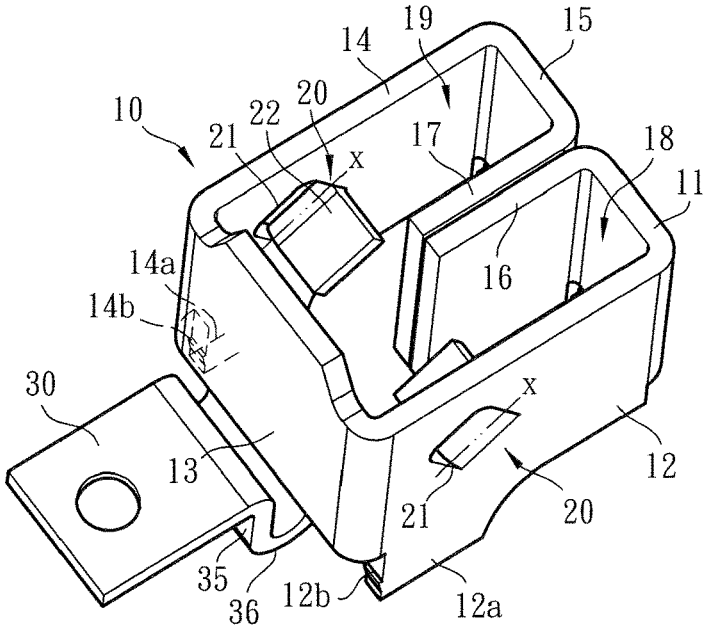
FIG. 22 is a perspective view of a preferred embodiment of the electrical contact limiter structure of the present invention, showing that the bottom end of the third side is formed with a subsidiary section, an arched section and an extension section.

Please now refer to FIG. 22. The second and fourth sides 12, 14 are formed with the assembling sections 21 and the stopper bodies 22 in the form of the plate structures. The first subsidiary side 16 extends to a position by a length larger than ½ of the length of the second side 12 so as to define a first space 18. The second subsidiary side 17 extends to a position by a length larger than ½ of the length of the fourth side 14 so as to define a second space 19. The first and second spaces 18, 19 communicate with each other. In addition, the leg sections 12*a*, 14*a* are formed at the bottom ends of the second and fourth sides 12, 14 of the limiter 10 and the finger sections 12*b*, 14*b* are formed on (lateral sides) of the leg sections 12*a*, 14*a*. The bottom end of the third side 13 of the limiter is bent toward the upper side of the drawing to form an arched section 36 and a subsidiary section 35 connected with the arched section 36. The subsidiary section 35 is further bent to a horizontal position and extends to form the extension section 30.

Figure 23:
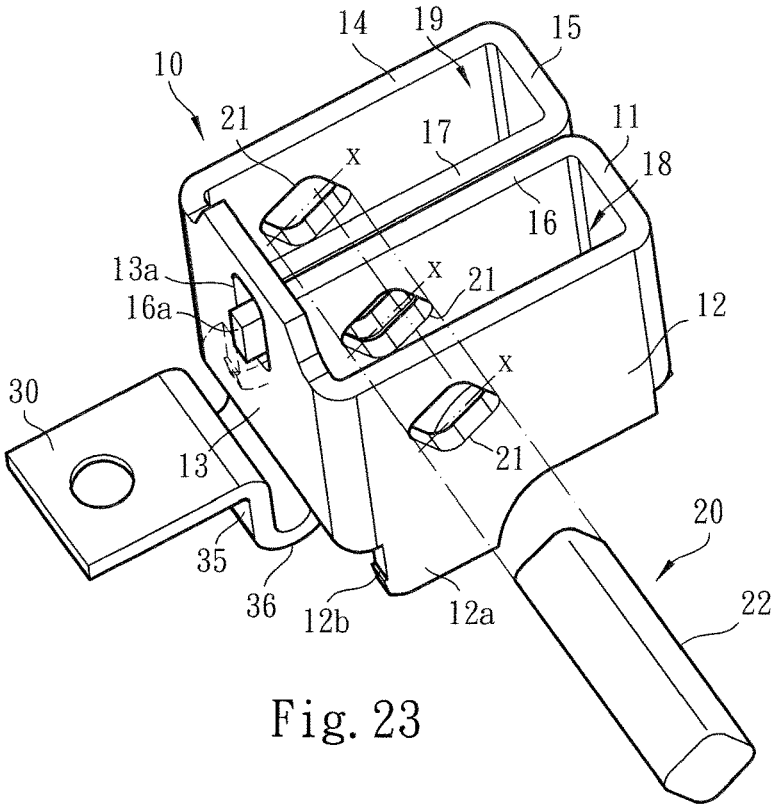
FIG. 23 is a perspective view of another embodiment of the electrical contact limiter structure of the present invention, showing that the first subsidiary side or the second subsidiary side extends through the third side and the structure of the limitation mechanism.

FIG. 23 shows a modified embodiment of FIG. 15. According to this embodiment, the bottom end of the third side 13 of the limiter is bent toward the upper side of the drawing to form an arched section 36 and a subsidiary section 35 connected with the arched section 36. The subsidiary section 35 is further bent to a horizontal position and extends to form the extension section 30.

Figure 24:
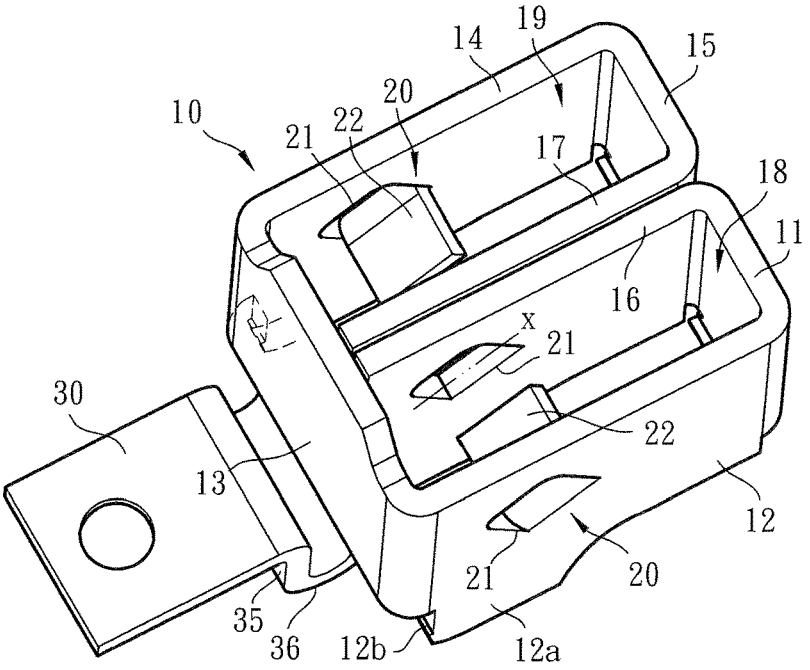
FIG. 24 is a perspective view of still another embodiment of the electrical contact limiter structure of the present invention, showing that the first and second subsidiary sides extend to a position in adjacency to the third side and the structure of the limitation mechanism.

FIG. 24 shows that the second and fourth sides 12, 14 are formed with the assembling sections 21 and the stopper bodies 22 in the form of the plate structures. The first subsidiary side 16 extends to a position in adjacency to the third side 13 so as to define the first space 18 with a fully closed periphery. The second subsidiary side 17 extends to a position in adjacency to the third side 13 so as to define the second space 19 with a fully closed periphery. In addition, the bottom end of the third side 13 of the limiter is bent toward the upper side of the drawing to form an arched section 36 and a subsidiary section 35 connected with the arched section 36. The subsidiary section 35 is further bent to a horizontal position and extends to form the extension section 30. FIG. 24 also shows that the first and second subsidiary sides 16, 17 are formed with the assembling sections 21.

Figure 25:
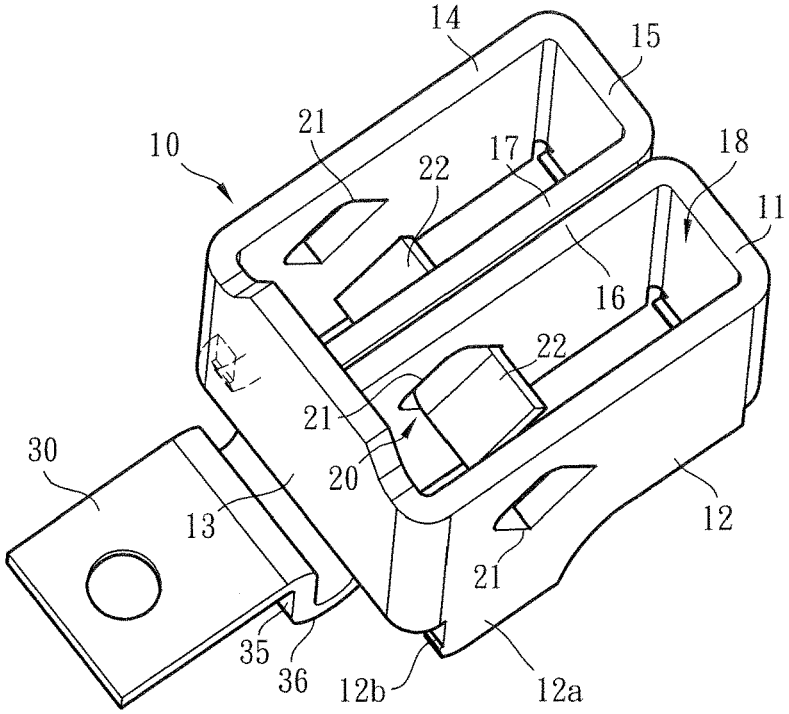
FIG. 25 is a perspective view of a preferred embodiment of the electrical contact limiter structure of the present invention, showing that the first and second subsidiary sides extend to a position in adjacency to the third side and the structure of the limitation mechanism.

FIG. 25 shows that the first and second subsidiary sides 16, 17 are formed with the assembling sections 21 and the stopper bodies 22 in the form of the plate structures. The first subsidiary side 16 extends to a position in adjacency to the third side 13 so as to define the first space 18 with a fully closed periphery. The second subsidiary side 17 extends to a position in adjacency to the third side 13 so as to define the second space 19 with a fully closed periphery. In addition, the bottom end of the third side 13 of the limiter is bent toward the upper side of the drawing to form an arched section 36 and a subsidiary section 35 connected with the arched section 36. The subsidiary section 35 is further bent to a horizontal position and extends to form the extension section 30. FIG. 25 also shows that the second and fourth sides 12, 14 are formed with the assembling sections 21.

Figure 26:
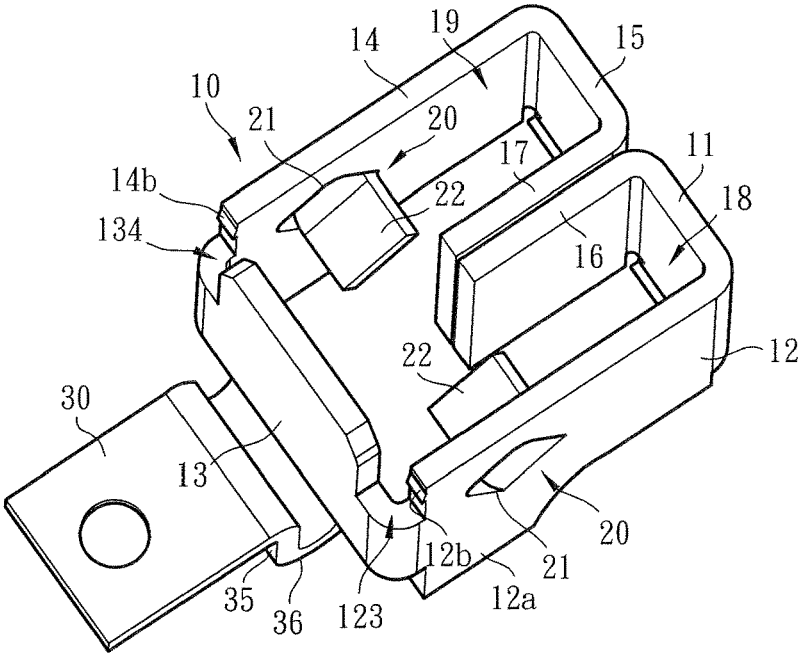
FIG. 26 is a perspective view of a modified embodiment of FIG. 22, showing the limitation mechanism and that a notch is formed at a junction between the second and third sides and another notch is formed at a junction between the third and fourth sides.

FIG. 26 shows a modified embodiment of FIG. 22. According to this embodiment, in the limiter 10, a notch 123 is formed at a junction between (the upper end) of the second side 12 and (the upper end) of the third side 13 and a notch 134 is formed at a junction between the third side 13 and the fourth side 14. The finger sections 12*b*, 14*b* are respectively formed on the lateral side of the upper end of the second side 12 in a position adjacent to the notch 123 and the lateral side of the upper end of the fourth side 14 in a position adjacent to the notch 134.

Figure 27:
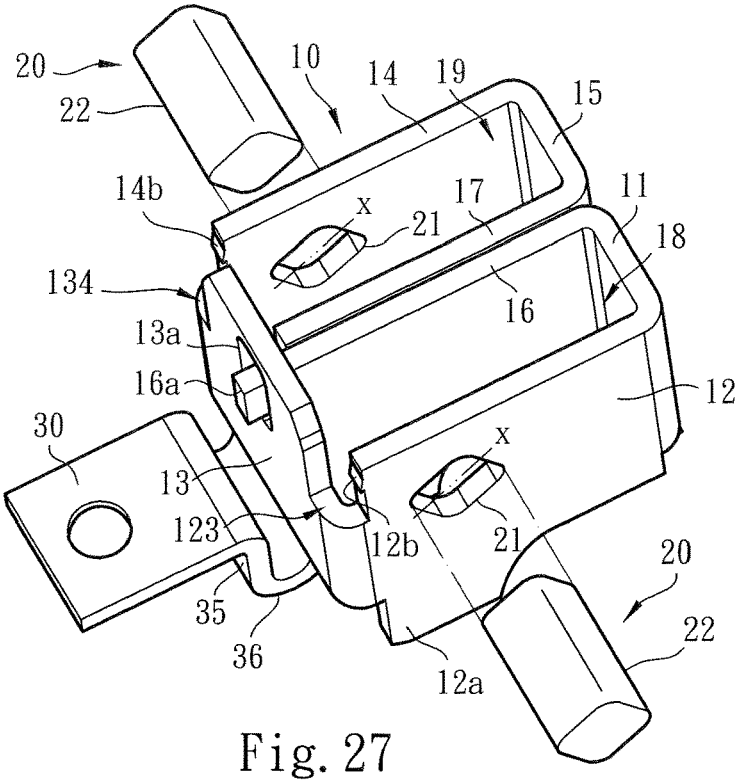
FIG. 27 is a perspective view of a preferred embodiment of the electrical contact limiter structure of the present invention, showing the limitation mechanism and that a notch is formed at a junction between the second and third sides and another notch is formed at a junction between the third and fourth sides.

FIG. 27 shows that the second and fourth sides 12, 14 are formed with the assembling sections 21 and the stopper body 22 in the form of a bolt body is assembled with the assembling sections 21. The protrusion end 16*a* of the first subsidiary side 16 passes through the window 13*a* of the third side to define the first space 18 with a fully closed periphery. The second subsidiary side 17 extends to a position in adjacency to the third side 13 so as to define the second space 19 with a fully closed periphery. In addition, in the limiter 10, a notch 123 is formed at a junction between (the upper end) of the second side 12 and (the upper end) of the third side 13 and a notch 134 is formed at a junction between the third side 13 and the fourth side 14. The finger sections 12*b*, 14*b* are respectively formed on the lateral side of the upper end of the second side 12 in a position adjacent to the notch 123 and the lateral side of the upper end of the fourth side 14 in a position adjacent to the notch 134.

Figure 28:
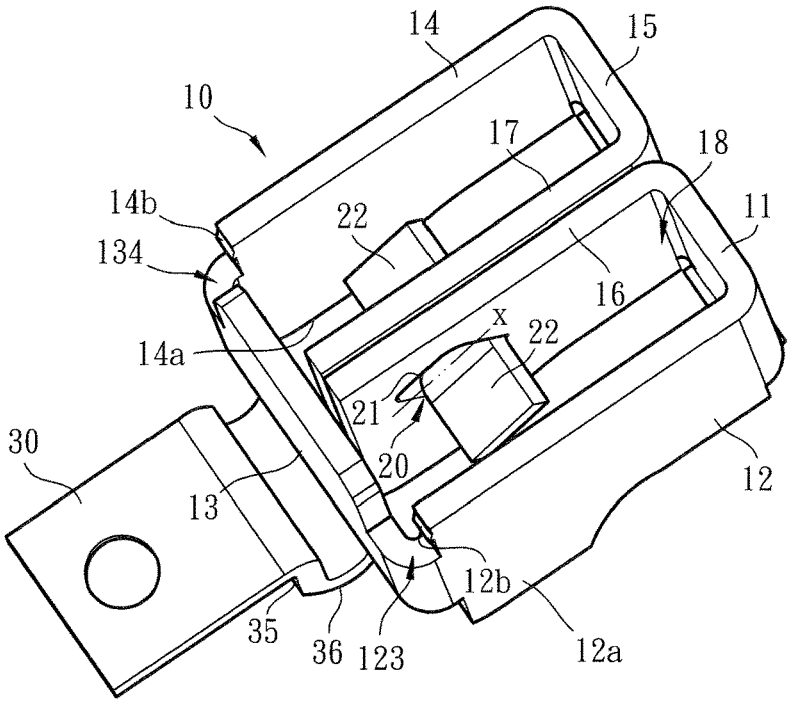
FIG. 28 is a perspective view of a modified embodiment of FIG. 25, showing the limitation mechanism and that a notch is formed at a junction between the second and third sides and another notch is formed at a junction between the third and fourth sides.

FIG. 28 shows that the first and second subsidiary sides 16, 17 are formed with the assembling sections 21 and the stopper bodies 22 in the form of the plate structures. The first subsidiary side 16 extends to a position in adjacency to the third side 13 so as to define the first space 18 with a fully closed periphery. The second subsidiary side 17 extends to a position in adjacency to the third side 13 so as to define the second space 19 with a fully closed periphery. In addition, in the limiter 10, a notch 123 is formed at a junction between (the upper end) of the second side 12 and (the upper end) of the third side 13 and a notch 134 is formed at a junction between the third side 13 and the fourth side 14. The finger sections 12*b*, 14*b* are respectively formed on the lateral side of the upper end of the second side 12 in a position adjacent to the notch 123 and the lateral side of the upper end of the fourth side 14 in a position adjacent to the notch 134. The bottom end of the third side 13 of the limiter is bent toward the upper side of the drawing to form an arched section 36 and a subsidiary section 35 connected with the arched section 36. The subsidiary section 35 is further bent to a horizontal position and extends to form the extension section 30.

To speak representatively, in the condition that the trend to design miniaturized terminal device is satisfied and the volume of the terminal device is not increased, in comparison with the conventional terminal device, the electrical contact limiter structure of wire connection terminal of the present invention has the following advantages:

1. The limiter 10, the limitation mechanism 20 and the relevant components and structures have been redesigned. For example, the limiter 10 includes a first side 11, a second side 12, a third side 13, a fourth side 14 and a fifth side 15. The first side 11 is bent to form a first subsidiary side 16. The fifth side 15 is bent to forma second subsidiary side 17 to together define a first space 18 and a second space 19 as a frame structure for receiving and restricting the metal leaf springs. The limitation mechanism 20 includes assembling sections 21 at least disposed on the second and fourth sides 12, 14 and/or the first and second subsidiary sides 16, 17. The assembling sections 21 are assembled with a stopper body 22 in the form of a bolt body or stopper bodies 22 in the form of plate structures extending and protruding from the assembling sections toward the interior of the limiter 10. The fixing structures or assembling relationship of the conventional electrical contact and metal leaf springs are changed and the present invention is obviously different from the conventional wire connection terminal in use and operation form.
2. Especially, the limiter 10 is assembled with the limitation mechanism 20 to restrict the moving range or bending angle of the metal leaf springs. This obviously improves the shortcoming of the conventional wire connection terminal that the due to the long-term or frequent external force operation, the metal leaf spring is often over-bent to cause material fatigue or breakage to affect the pressing or biting effect of the metal leaf spring for the conductive wire. Accordingly, the operation of an operator is facilitated and the limiter and the limitation mechanism are easy to manufacture. Moreover, the shortcomings of the conventional wire connection terminal that the metal bare end of the conductive wire is apt to thrust and damage the case or deflect the metal leaf spring or scrape and break the case and the holding is unstable are as minimized as possible.

3. In case the stopper body has an inclination angle of 0 degree and is parallel to the first side, the third side or the fifth side, the sharp edge of the stopper body will be positioned in the moving path of the pressed down metal leaf spring. As a result, during the long-term and high-frequency operation, the metal leaf spring is easy to damage. Such cooperative structures are not ideal. Therefore, the assembling sections 21 and the stopper bodies 22 are arranged in an inclined state so that when an operator presses down and bend the metal leaf spring, the metal leaf spring is pressed against the plane face section of the stopper bodies 22. This not only can minify the possibility of over-bending of the metal leaf spring, but also is beneficial to the pressing/leaning cooperation between the metal leaf spring and the stopper bodies 22.

In conclusion, the electrical contact limiter structure of wire connection terminal of the present invention is different from the conventional wire connection terminal in space form and is advantageous over the conventional wire connection terminal. The electrical connector limiter structure of wire connection terminal of the present invention is greatly advanced and inventive.

The above embodiments are only used to illustrate the present invention, not intended to limit the scope thereof. Many modifications of the above embodiments can be made without departing from the spirit of the present invention.

What is claimed is:

1. An electrical contact limiter structure of wire connection terminal for restricting the moving path and range of a metal leaf spring, the limiter structure comprising a limiter and a limitation mechanism assembled with the limiter, the limiter at least having a first side, a second side connected with the first side, a third side connected with the second side and a fourth side connected with the third side, wherein the first side is bent toward the third side and extends to form a first subsidiary side, the fourth side being bent toward the second side and extending to form a fifth side, the fifth side and the first side being positioned on the same plane face, the fifth side being bent toward the third side and extending to form a second subsidiary side, whereby the limiter defines a frame structure divided into a first space and a second space, the limitation mechanism including assembling sections disposed on the limiter and stopper bodies assembled with the assembling sections.

2. The electrical contact limiter structure of wire connection terminal as claimed in claim 1, wherein:

the first and second subsidiary sides are side by side arranged in parallel to each other, and the first and second subsidiary sides respectively have a length larger than or equal to ½ of a length of the second and fourth sides.

3. The electrical contact limiter structure of wire connection terminal as claimed in claim 2, wherein the first subsidiary side extends to a position in adjacency to the third side so as to define a first space with a fully closed periphery, the second subsidiary side extending to a position in adjacency to the third side so as to define a second space with a fully closed periphery.

4. The electrical contact limiter structure of wire connection terminal as claimed in claim 3, wherein the third side is formed with a window and at least one of the first and second subsidiary sides is formed with a protrusion end extending into the window.

5. The electrical contact limiter structure of wire connection terminal as claimed in claim 1, wherein the assembling sections of the limitation mechanism are formed on the second and fourth sides, the stopper bodies being plate structures extending and protruding from the assembling sections toward an interior of the limiter, the stopper bodies being arranged by an inclination angle, the stopper bodies being arranged by such an inclination angle that the stopper bodies are downward inclined from the first side toward the third side.

6. The electrical contact limiter structure of wire connection terminal as claimed in claim 2, wherein the assembling sections of the limitation mechanism are formed on the second and fourth sides, the stopper bodies being plate structures extending and protruding from the assembling sections toward an interior of the limiter, the stopper bodies being arranged by an inclination angle, the stopper bodies being arranged by such an inclination angle that the stopper bodies are downward inclined from the first side toward the third side.

7. The electrical contact limiter structure of wire connection terminal as claimed in claim 3, wherein the assembling sections of the limitation mechanism are formed on the second and fourth sides, the stopper bodies being plate structures extending and protruding from the assembling sections toward an interior of the limiter, the stopper bodies being arranged by an inclination angle, the stopper bodies being arranged by such an inclination angle that the stopper bodies are downward inclined from the first side toward the third side.

8. The electrical contact limiter structure of wire connection terminal as claimed in claim 4, wherein the assembling sections of the limitation mechanism are formed on the second and fourth sides, the stopper bodies being plate structures extending and protruding from the assembling sections toward an interior of the limiter, the stopper bodies being arranged by an inclination angle, the stopper bodies being arranged by such an inclination angle that the stopper bodies are downward inclined from the first side toward the third side.

9. The electrical contact limiter structure of wire connection terminal as claimed in claim 3, wherein the assembling sections of the limitation mechanism are formed on the first and second subsidiary sides, the stopper bodies being plate structures respectively extending and protruding from the assembling sections toward the first and second spaces of the limiter, the stopper bodies being arranged by an inclination angle, the stopper bodies being arranged by such an inclination angle that the stopper bodies are downward inclined from the first side toward the third side.

10. The electrical contact limiter structure of wire connection terminal as claimed in claim 3, wherein the assembling sections of the limitation mechanism are formed on the second and fourth sides and the first and second subsidiary sides, the stopper bodies being plate structures respectively extending and protruding from at least one of the assembling sections of the second side and the first subsidiary side and at least one of the assembling sections of the fourth side and the second subsidiary side toward the first and second spaces, the stopper bodies being arranged by an inclination angle, the stopper bodies being arranged in such an inclination angle that the stopper bodies are downward inclined from the first side toward the third side.

11. The electrical contact limiter structure of wire connection terminal as claimed in claim 4, wherein the assembling sections of the limitation mechanism are formed on the second and fourth sides and the first and second subsidiary sides, the stopper bodies being plate structures respectively extending and protruding from at least one of the assembling sections of the second side and the first subsidiary side and at least one of the assembling sections of the fourth side and the second subsidiary side toward the first and second spaces, the stopper bodies being arranged by an inclination angle, the stopper bodies being arranged in such an inclination angle that the stopper bodies are downward inclined from the first side toward the third side.

12. An electrical contact limiter structure of wire connection terminal for restricting the moving path and range of a metal leaf spring, the limiter structure comprising a limiter and a limitation mechanism assembled with the limiter, the limiter at least having a first side, a second side connected with the first side, a third side connected with the second side and a fourth side connected with the third side, wherein two leg sections respectively protrude from a bottom end of the second side and a bottom end of the fourth side and finger sections are respectively formed on lateral sides of the leg sections, one of an upper end and a lower end of the third side being perpendicularly bent to form an extension section, wherein the limiter defines a frame structure with at least one space, the limitation mechanism including assembling sections disposed on the limiter and stopper bodies assembled with the assembling sections.

13. The electrical contact limiter structure of wire connection terminal as claimed in claim 2, wherein two leg sections respectively protrude from a bottom end of the second side and a bottom end of the fourth side and finger sections are respectively formed on lateral sides of the leg sections, one of an upper end and a lower end of the third side being perpendicularly bent to form an extension section.

14. The electrical contact limiter structure of wire connection terminal as claimed in claim 3, wherein two leg sections respectively protrude from a bottom end of the second side and a bottom end of the fourth side and finger sections are respectively formed on lateral sides of the leg sections, one of an upper end and a lower end of the third side being perpendicularly bent to form an extension section.

15. An electrical contact limiter structure of wire connection terminal for restricting the moving path and range of a metal leaf spring, the limiter structure comprising a limiter and a limitation mechanism assembled with the limiter, the limiter at least having a first side, a second side connected with the first side, a third side connected with the second side and a fourth side connected with the third side, wherein a notch is formed at a junction between an upper end of the second side and an upper end of the third side and another notch is formed at a junction between the third side and the fourth side, a finger section being formed on a lateral side of the upper end of the second side in a position adjacent to the notch between the second and third sides, another finger section being formed on a lateral side of the upper end of the fourth side in a position adjacent to the notch between the third side and the fourth side, one of an upper end and a lower end of the third side being perpendicularly bent to form an extension section, wherein the limiter defines a frame structure with at least one space, the limitation mechanism including assembling sections disposed on the limiter and stopper bodies assembled with the assembling sections.

16. The electrical contact limiter structure of wire connection terminal as claimed in claim 2, wherein a notch is formed at a junction between an upper end of the second side and an upper end of the third side and another notch is formed at a junction between the third side and the fourth side, a finger section being formed on a lateral side of the upper end of the second side in a position adjacent to the notch between the second and third sides, another finger section being formed on a lateral side of the upper end of the fourth side in a position adjacent to the notch between the third side and the fourth side, one of an upper end and a lower end of the third side being perpendicularly bent to form an extension section.

17. The electrical contact limiter structure of wire connection terminal as claimed in claim 3, wherein a notch is formed at a junction between an upper end of the second side and an upper end of the third side and another notch is formed at a junction between the third side and the fourth side, a finger section being formed on a lateral side of the upper end of the second side in a position adjacent to the notch between the second and third sides, another finger section being formed on a lateral side of the upper end of the fourth side in a position adjacent to the notch between the third side and the fourth side, one of an upper end and a lower end of the third side being perpendicularly bent to form an extension section.

18. The electrical contact limiter structure of wire connection terminal as claimed in claim 12, wherein the bottom end of the third side is bent upward to form a subsidiary section and the subsidiary section is bent to a horizontal position and extends to form the extension section.

19. The electrical contact limiter structure of wire connection terminal as claimed in claim 13, wherein the bottom end of the third side is bent upward to form a subsidiary section and the subsidiary section is bent to a horizontal position and extends to form the extension section.

20. The electrical contact limiter structure of wire connection terminal as claimed in claim 18, wherein the bottom end of the third side is bent upward to form an arched section, the arched section being connected with the subsidiary section.

* * * * *